US007336913B2

(12) United States Patent
Sato et al.

(10) Patent No.: US 7,336,913 B2
(45) Date of Patent: Feb. 26, 2008

(54) DEVELOPING APPARATUS, PROCESS CARTRIDGE AND IMAGE FORMING APPARATUS FOR PREVENTING LEAKAGE

(75) Inventors: Fumikazu Sato, Konan (JP); Masahiro Ishii, Nagoya (JP); Yukiko Nakaya, Konan (JP); Hiroya Fukuta, Nagoya (JP); Nao Itabashi, Nagoya (JP); Isao Kishi, Nagoya (JP); Takeshi Fuwazaki, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 205 days.

(21) Appl. No.: 11/190,206

(22) Filed: Jul. 27, 2005

(65) Prior Publication Data

US 2006/0024085 A1 Feb. 2, 2006

(30) Foreign Application Priority Data

Jul. 29, 2004 (JP) ..... 2004-222535
Jul. 29, 2004 (JP) ..... 2004-222537

(51) Int. Cl.
*G03G 15/08* (2006.01)

(52) U.S. Cl. ..... 399/103; 399/105; 399/284

(58) Field of Classification Search ..... 399/102, 399/103, 105, 284, 286
See application file for complete search history.

(56) References Cited

U.S. PATENT DOCUMENTS 6,094,550 A 7/2000 Kido et al.
6,336,014 B1 1/2002 Sato et al.
6,535,709 B2 3/2003 Yokomori et al.
6,937,831 B2 * 8/2005 Kamimura ..... 399/103
2002/0028086 A1 3/2002 Sato et al.

FOREIGN PATENT DOCUMENTS

| | | |
|---|---|---|
| JP | 07134494 | 5/1995 |
| JP | 07301991 | 11/1995 |
| JP | 08129303 | 5/1996 |
| JP | 11-073017 | 3/1999 |
| JP | 2001027844 | 1/2001 |
| JP | 2001-356592 | 12/2001 |
| JP | 2004133394 | 4/2004 |

OTHER PUBLICATIONS

European Search Report for corresponding European Application No. 05016466.4.

* cited by examiner

*Primary Examiner*—Hoang Ngo
(74) *Attorney, Agent, or Firm*—Banner & Witcoff, Ltd

(57) ABSTRACT

The blade back seal and the sponge sealing member are interposed between the leaf spring member and the blade attachment unit and seal arrangement portion while being compressed to have the same thickness, by applying the blade back seal having a relatively small elastic modulus and a large thickness to the blade attachment unit and the seal arrangement portion, applying the sponge sealing member having a relatively large elastic modulus and a small thickness onto the roller opposed face of the seal arrangement portion and pressing them by the leaf spring member of the blade unit.

30 Claims, 24 Drawing Sheets

DEVELOPING APPARATUS, PROCESS CARTRIDGE AND IMAGE FORMING APPARATUS FOR PREVENTING LEAKAGE

CROSS-REFERENCE TO RELATED APPLICATIONS

This Nonprovisional application claims priority under 35 U.S.C. §119(a) on Patent Application No. 2004-222535 filed in Japan on Jul. 29, 2004 and Patent Application No. 2004-222537 filed in Japan on Jul. 29, 2004, the entire contents of which are hereby incorporated by reference.

BACKGROUND

The present invention relates to a developing apparatus, a process cartridge and an image forming apparatus.

In an image forming apparatus such as a laser printer, an electrostatic latent image is formed on the surface of a photoconductor drum and developer is supplied to the electrostatic latent image from a developing apparatus, so that a developer image is retained on the surface of the photoconductor drum. The developer image is then transferred to a paper sheet, so that formation of an image on the paper sheet is achieved.

A developing apparatus comprises: a case having an opening faced to the photoconductor drum; a developer retainer for retaining developer which is held in the case; and a blade for regulating the layer thickness of developer to be retained by the developer retainer. The developer retainer is supported so as to be rotatable with a portion of the surface thereof being exposed at the opening of the case. The blade is composed of a sheet-like elastic blade extending in the axial direction of the developer retainer and a support plate for supporting this elastic blade. The elastic blade has an upper end portion, which is welded to the support plate by spot welding at constant intervals (10 mm, for example) in the longitudinal direction, and a lower end portion, which is welded to the surface of the developer retainer by pressure welding, so as to press the developer retainer uniformly in the longitudinal direction. (See Japanese Patent Application Laid-Open No. 2001-356592, for example). The developer in the case is supplied onto the surface of the developer retainer, carried between the blade and the surface of the developer retainer with the rotation of the developer retainer and retained on the surface of the developer retainer as a thin layer having a constant thickness. The developer retained on the surface of the developer retainer is supplied to the electrostatic latent image formed on the surface of the photoconductor drum when the developer comes in contact with the surface of the photoconductor drum.

Such a developing apparatus is usually provided with sealing members for preventing leakage of toner from the longitudinal end portions of the developer retainer. The sealing members are arranged adjacent to the longitudinal end portions of the developer retainer and pressed to the surface of the longitudinal end portions of the developer retainer. Suggested is, for example, to compose such a sealing member of an upstream sealing member and a downstream sealing member having different elasticity, arrange the upstream sealing member having larger elasticity on the upstream side in the rotative direction of the developer retainer and arrange the downstream sealing member having smaller elasticity on the downstream side (see Japanese Patent Application Laid-Open No. H11-73017/1999, for example).

SUMMARY

The structure described in Japanese Patent Application Laid-Open No. H11-73017/1999, however, has a problem that developer leaks from a clearance between the downstream sealing member and the developer retainer since the pressing force to the developer retainer by the downstream sealing member becomes smaller than the pressing force to the developer retainer by the upstream sealing member.

Furthermore, the structure described in Japanese Patent Application Laid-Open No. 2001-356592 has a problem that undulation is generated at the elastic blade since the pressure welding force of the elastic blade to the support plate at one welded portion is microscopically different from that of the other welded portion between the welded portions. When undulation is generated at the elastic blade, a dispersion is generated in the pressing force of the elastic blade to the surface of the developer retainer in the axial direction of the developer retainer and the thin layer of developer to be retained on the surface of the developer retainer cannot be regulated to have a uniform thickness and, as a result, an image with undesirable shading is formed on the paper sheet.

It is an object to provide: a developing apparatus capable of reliably preventing leakage of developer from a clearance between a pressing member and a case at an opening of the case using a first sealing member and a second sealing member having different elasticity; a process cartridge comprising this developing apparatus; and an image forming apparatus comprising such a developing apparatus or a process cartridge.

Another object is to provide: a developing apparatus capable of preventing flexion such as undulation of a blade and retaining a thin layer of developer having a uniform thickness on the surface of a developer retainer; a process cartridge comprising this developing apparatus; and an image forming apparatus comprising such a developing apparatus or a process cartridge.

In order to achieve the above objects, a developing apparatus according to the first aspect is characterized by comprising: a case having a slit-shaped opening; a developer retainer which is arranged along a longitudinal direction of the opening and supported by the case so as to be rotatable; and a pressing member, which is arranged at the opening of the case, for pressing a first sealing member and a second sealing member, wherein the first sealing member has a first elastic modulus and is arranged at the opening of the case and interposed between the pressing member and the case while being compressed by a first compressibility, and the second sealing member has a second elastic modulus smaller than the first elastic modulus and is arranged adjacent to the first sealing member at the opening of the case and interposed between the pressing member and the case while being compressed by a second compressibility larger than the first compressibility.

With such a structure, since the first elastic modulus is larger than the second elastic modulus and a first compressibility is smaller than a second compressibility, it is possible to decrease a difference between the force for pressing the pressing member and the case by the first sealing member and the force for pressing the pressing member and the case by the second sealing member. It is therefore possible to reliably prevent leakage of developer from a clearance between the pressing member and the case at the opening of the case, using the first sealing member and the second sealing member having different elasticity.

Moreover, a developing apparatus according to the second aspect is characterized by comprising: a case having an opening; a developer retainer, which is arranged with a portion of surface being exposed at the opening and is supported by the case so as to be rotatable, for retaining developer at a surface thereof, a blade, which is formed to have a sheet-like shape, is disposed in a longitudinal direction of the developer retainer and has one side end portion in a direction crossing a longitudinal direction thereof that presses a surface of the developer retainer, for regulating a layer thickness of developer to be retained on a surface of the developer retainer; supporting means for supporting the other side end portion of the blade along a longitudinal direction of the blade; a first fastening member and a second fastening member for fastening the blade to the supporting means respectively at longitudinal end portions of the blade; and a reinforcing portion, which is provided at least between the first fastening member and the second fastening member, for reinforcing the blade.

With such a structure, since the longitudinal end portions of the blade are fastened to the supporting means by the first fastening member and the second fastening member and a reinforcing portion is provided between the first fastening member and the second fastening member, it is possible to prevent flexion such as undulation or deflection of the blade between the first fastening member and the second fastening member. As a result, it is possible to press the surface of the developer retainer with uniform force by the blade and to retain a thin layer of developer having a uniform thickness on the surface of the developer retainer.

With the first aspect, it is possible to reliably prevent leakage of developer from a clearance between the pressing member and the case at the opening of the case, using the first sealing member and the second sealing member having different elasticity.

With the second aspect, it is possible to prevent flexion such as undulation or deflection of the blade. As a result, it is possible to press the surface of the developer retainer with uniform force by the blade and to retain a thin layer of developer having a uniform thickness on the surface of the developer retainer.

The above and further objects and features will more fully be apparent from the following detailed description with accompanying drawings.

DETAILED DESCRIPTION OF THE EXEMPLARY EMBODIMENTS

Figure 1:
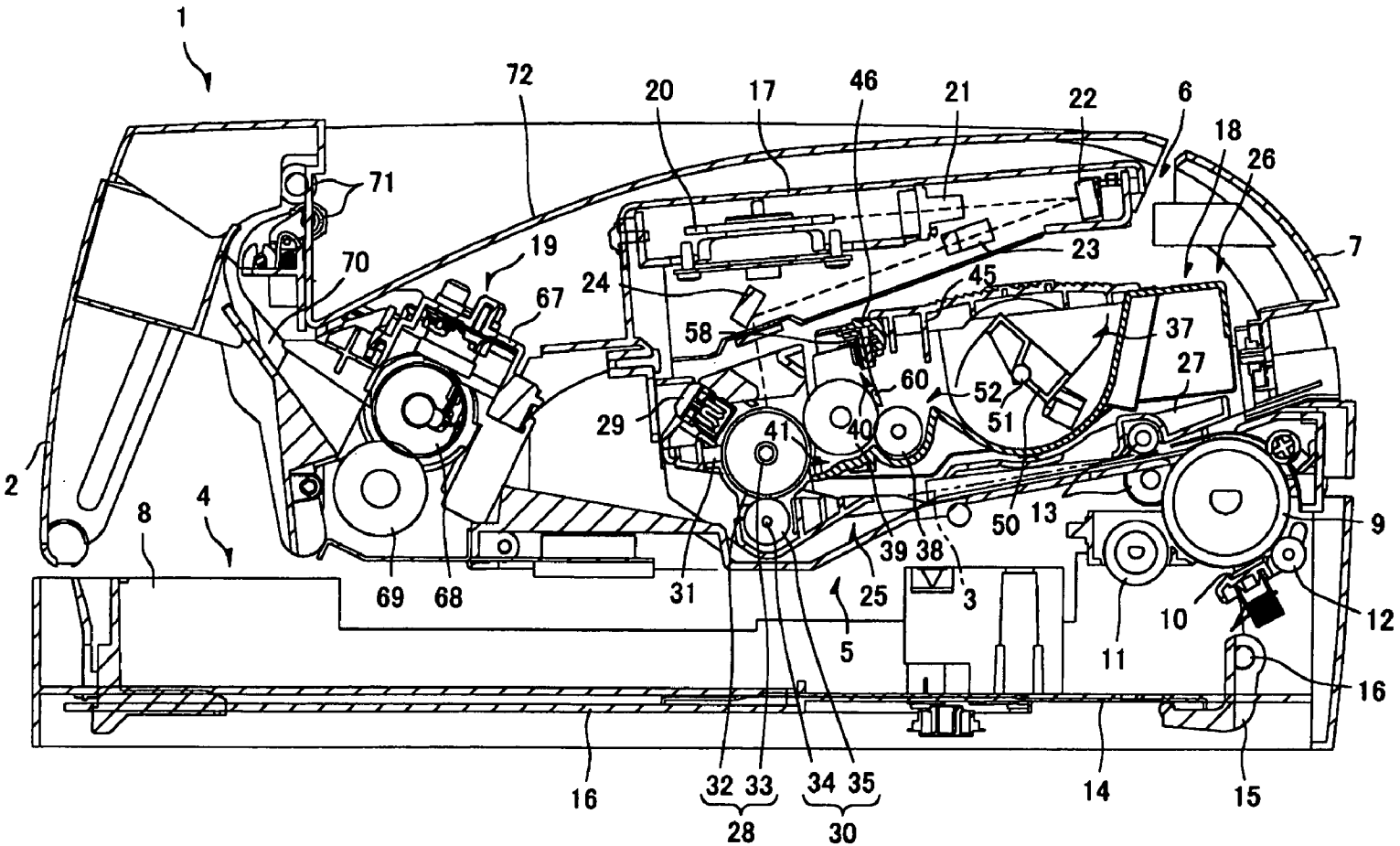
FIG. 1 is an essential part sectional side view showing an embodiment of a laser printer which functions as an image forming apparatus.

FIG. 1 is an essential part sectional side view showing an embodiment of a laser printer which functions as an image forming apparatus. In FIG. 1, the laser printer 1 comprises a feeder unit 4 for feeding a paper sheet 3, an image forming unit 5 for forming an image on a fed paper sheet 3, and the like in a body casing 2.

On one sidewall of the body casing 2, an insertion port 6 for attaching and detaching a later-described process cartridge 18 is formed and a front cover 7 for opening and closing the insertion port 6 is provided. This front cover 7 is supported by a cover shaft, which is inserted into a lower end portion thereof and is not illustrated in the figure, so as to be freely rotatable. Thus, the insertion port 6 is closed by the front cover 7 when the front cover 7 is closed around the covering shaft as the center, while the insertion port 6 is opened when the front cover 7 is opened (tilted) around the covering shaft as the supporting point, so that the process cartridge 18 can be attached to or detached from the body casing 2 through this insertion port 6. Moreover, an operation panel, which comprises operation keys and an LED display unit and is not illustrated in the figure, is embedded in the front cover 7.

It should be noted that a side of this laser printer 1 where the front cover 7 is provided will be hereinafter referred to as "front side" and the opposite side will be referred to as "back side".

The feeder unit 4 comprises: a paper feed tray 8 to be mounted detachably at the bottom portion of the body casing 2; a paper feed roller 9 and a paper feed pad 10 provided above a front end portion of the paper feed tray 8; a pickup roller 11 provided behind the paper feed roller 9; a pinch roller 12 arranged opposite below the front side of the paper feed roller 9; and a resist roller 13 provided above the back side of the paper feed roller 9.

A paper pressing plate 14 is provided inside the paper feed tray 8 so that paper sheets 3 can be laid thereon in a laminated manner. This paper pressing plate 14 is supported at the back end portion thereof so as to swing, so that the front end portion can be moved in the vertical direction.

Moreover, the front end portion of the paper feed tray 8 is provided with a lever 15 for lifting the front end portion of the paper pressing plate 14 upward. This lever 15 is formed to have a substantially L-shaped section so as to go round from the front side to the lower side of the paper pressing plate 14, and the upper end portion thereof is attached to a lever shaft 16 provided at the front end portion of the paper feed tray 8 and the back end portion thereof is in contact with the front end portion of the lower surface of the paper pressing plate 14. Thus, when rotational driving force in the clockwise direction in the figure is inputted to the lever shaft 16, the lever 15 is rotated around the lever shaft 16 as the supporting point and the back end portion of the lever 15 lifts the front end portion of the paper pressing plate 14.

When the front end portion of the paper pressing plate 14 is lifted, the top paper sheet 3 on the paper pressing plate 14 is pressed by the pickup roller 11 and starts to be carried toward the space between the paper feed roller 9 and the paper feed pad 10 by the rotation of the pickup roller 11.

On the other hand, when the paper feed tray 8 is detached from the body casing 2, the front end portion of the paper pressing plate 14 moves downward by its own weight and is made along the bottom face of the paper feed tray 8. In this state, paper sheets 3 can be laid on the paper pressing plate 14 in a laminated manner.

Paper sheets 3 sent toward the space between the paper feed roller 9 and the paper feed pad 10 by the pickup roller 11 are surely separated into respective sheets and fed when being interposed between the paper feed roller 9 and the paper feed pad 10 by the rotation of the paper feed roller 9. A fed paper sheet 3 is carried between the paper feed roller 9 and the pinch roller 12 to the resist roller 13.

The resist roller 13 is composed of a pair of rollers facing each other, and carries the paper sheet 3 toward a transfer position of the image forming unit 5 (a nip position between a photoconductor drum 28 and a transfer roller 30, which will be explained later, for transferring a toner image on the photoconductor drum 28 to the paper sheet 3) after resist.

The image forming unit 5 comprises a scanner unit 17, the process cartridge 18, a fixing unit 19 and the like.

The scanner unit 17 is provided at the upper portion in the body casing 2, and comprises a laser source which is not illustrated in the figure, a polygon mirror 20 driven to rotate, an fθ lens 21, a reflecting mirror 22, a lens 23, another reflecting mirror 24 and the like. A laser beam based on image data, which is emitted from the laser source, is deflected by the polygon mirror 20 as shown in the chain line and passes the fθ lens 21. The optical path thereof is then folded by the reflecting mirror 22, the laser beam further passes the lens 23, and the optical path is further inflected downward by the reflecting mirror 24, so that the laser beam is irradiated onto the surface of the later-described photoconductor drum 28 of the process cartridge 18 by rapid scanning.

The process cartridge 18 is mounted detachably to the body casing 2 below the scanner unit 17. This process cartridge 18 comprises a drum cartridge 25 and a developing cartridge 26 which is mounted detachably to the drum cartridge 25 as a developing apparatus.

The drum cartridge 25 comprises: the developing cartridge 26 mounted at the front side; and the photoconductor drum 28, a scorotron charger 29, the transfer roller 30 and a cleaning brush 31 provided at the back side thereof, between a pair of side plates 27, which respectively extend in the anteroposterior direction and are arranged opposite to each other in a direction crossing the anteroposterior direction (direction crossing the paper surface of FIG. 1, which will be hereinafter referred to just as "width direction").

The photoconductor drum 28 comprises: a cylindrical drum body 32 having the surface layer formed of a positively-charged photosensitive layer made of polycarbonate or the like; and a drum shaft 33 made of metal, which extends along the longitudinal direction of the drum body 32 at the axis of this drum body 32. The drum shaft 33 is supported at the side plates 27 of the drum cartridge 25 so as not to be rotatable and the drum body 32 is supported so as to be rotatable with respect to this drum shaft 33, so that the photoconductor drum 28 is provided between the side plates 27 so as to be rotatable on the drum shaft 33.

The scorotron charger 29 is arranged opposite to the photoconductor drum 28 at a distance obliquely above the back side of the photoconductor drum 28 so as not to come in contact with the photoconductor drum 28. This scorotron charger 29 is a charger of scorotron type for positive charge which generates corona discharge from a charging wire such as tungsten, and is provided so as to positively charge the surface of the photoconductor drum 28 uniformly.

The transfer roller 30 is supported at the side plates 27 of the drum cartridge 25 so as to be freely rotatable, and is arranged so as to face and come in contact with the photoconductor drum 28 in the vertical direction and to form a nip between the photoconductor drum 28 and the transfer roller 30. This transfer roller 30 is constructed by coating a roller shaft 34 made of metal with a roller 35 made of conductive rubber material. On transfer, transfer bias is applied to the transfer roller 30.

The cleaning brush 31 is arranged behind the photoconductor drum 28 with a point of the brush being in contact with the surface of the drum body 32 of the photoconductor drum 28.

Figure 2:
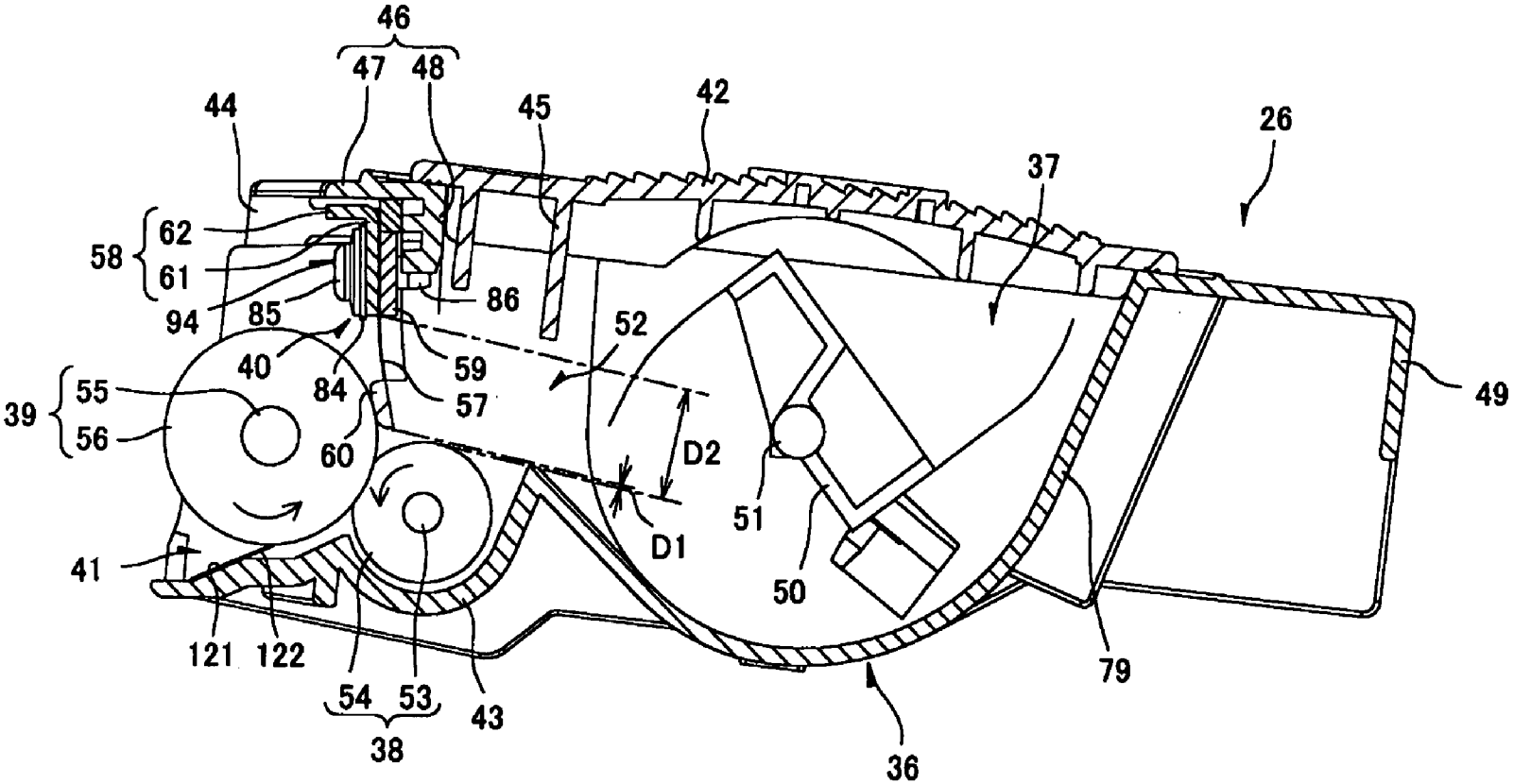
FIG. 2 is a sectional side view of a developing cartridge shown in FIG. 1.

The developing cartridge 26 comprises: a case 36; and a toner holding chamber 37, a feed roller 38, a developing roller 39 as a developer retainer, and a blade unit 40 as a pressing member in this case 36, as shown in FIG. 2.

The case 36 is formed to have a box-like shape which has a slit-shaped opening 41 at the back end portion.

Figure 3:
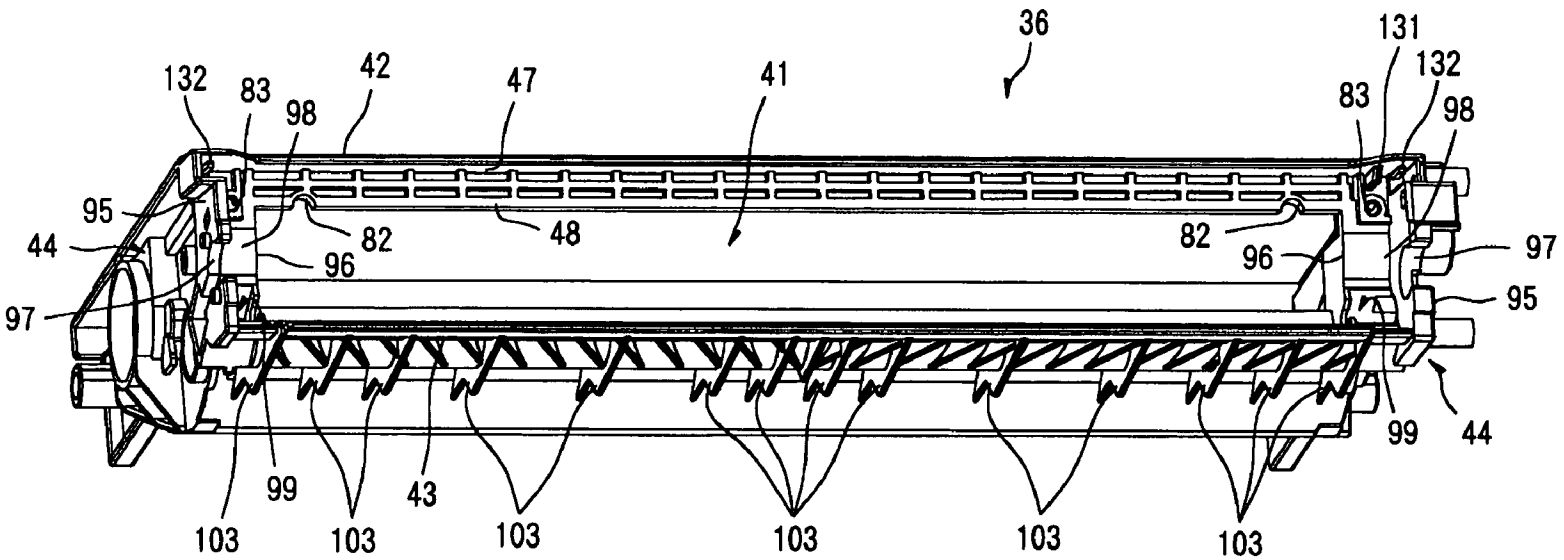
FIG. 3 is a perspective view of a case of the developing cartridge shown in FIG. 2.

In particular, as shown in FIGS. 2 and 3, the case 36 comprises: an upper wall 42 and a lower wall 43 which face each other in the vertical direction; a pair of sidewalls 44 provided so as to close the space between these upper wall 42 and lower wall 43 from both width-direction sides; and a front wall 79 provided so as to close the space between the upper wall 42 and the lower wall 43 from the front side.

The upper wall 42 comprises a partition plate 45 which extends from a middle portion in the anteroposterior direction nearer to the back side toward the lower wall 43 as shown in FIG. 2. This partition plate 45 separates the internal space of the case 36 and the internal space at the front side is blocked out as the toner holding chamber 37. Moreover, a blade attachment unit 46 which functions as a connecting unit for attaching the blade unit 40 is provided at the back end portion of the upper wall 42, and the slit-shaped opening 41 which extends in the width direction is blocked out by this blade attachment unit 46, the lower wall 43 and the pair of sidewalls 44. A direction in which the toner holder 37 and the opening 41 communicate is referred to as a communication direction. That is, in the present embodiment, the communication direction accords with the anteroposterior direction.

The blade attachment unit 46 is formed to have an L-shaped side section. In particular, the blade attachment unit 46 comprises: a plate-like upper attachment portion 47, which faces the lower wall 43, extends in the width direction and has a width in the anteroposterior direction; and a front attachment portion 48, which is inflected downward from the front end portion of the upper attachment portion 47, extends in the width direction, has a width in the vertical direction and is provided with a lattice-like recess seen from the backside. This blade attachment unit 46 may be formed separately from the upper wall 42 and fastened to the upper wall 42, or may be formed integrally with the upper wall 42. When the blade attachment unit 46 is formed integrally with the upper wall 42, it is possible to reduce the number of components of this laser printer 1 and to simplify the structure.

At the front attachment portion 48, as shown in FIG. 3, recesses 82 for preventing collision with later-described assembly screws 94 are formed by notching the lower edge of the longitudinal end portions in a semi-circular shape. Moreover, at the front attachment portion 48, tapped holes 83 for screwing later-described attachment screws 100 on attaching the blade unit 40 to the blade attachment unit 46 (front attachment portion 48) are formed at positions at a distance from the respective recesses 82 outward in the longitudinal direction. Furthermore, positioning ribs 131 and 132 to be engaged with a later-described bend preventing member 58 of the blade unit 40 so as to position the blade unit 40 at the case 36 are formed above the tapped holes 83 of the front attachment portion 48. The positioning rib 131 positions the blade unit 40 in the longitudinal direction of the opening 41. The positioning rib 132 positions the blade unit 40 in the vertical direction of the opening 41. These positioning ribs 131 and 132 prevent displacement caused by thread fastening on attaching the blade unit 40 to the blade attachment unit 46 by the attachment screws 100.

The front end portion of the lower wall 43 extends obliquely upward from the front side and is connected in succession with the front wall 79 as shown in FIG. 2. Moreover, a film arrangement portion 121 which extends along the axial direction of the developing roller 39 is formed at the back upper surface of the lower wall 43. This film arrangement portion 121 is made of polyethylene terephthalate and is provided with a lower film 122 to be frictioned uniformly with the outer surface of a roller 56 of the developing roller 39 along the axial direction thereof. Since the lower film 122 is frictioned uniformly with the outer surface of the roller 56 of the developing roller 39 along the axial direction thereof above the lower wall 43, it is possible to prevent toner leakage from between the lower wall 43 and the developing roller 39. Furthermore, as shown in FIG. 3, a plurality of ribs 103 are formed at the lower surface of the lower wall 43 so as to extend respectively in the anteroposterior direction at a distance in the width direction. The ribs 103 formed at the width-direction end portions of the lower surface of the lower wall 43 extend in the anteroposterior direction along the width-direction internal edge of a lower face 102 of later-described seal arrangement portions 96 and function also as a guide for arranging a later-described felt sealing member 93.

Each of the sidewalls 44 comprises: a support plate portion 95 for supporting the developing roller 39; and the seal arrangement portion 96, which is a side portion where a seal side portion 88 of a blade back seal 87 that will be explained later and a side seal 91 are arranged, at the opening 41 as shown in FIG. 3.

The support plate portion 95 is of plate-like shape extending in the vertical direction, and is provided with a bearing hole 97 for bearing a roller shaft 55 of the developing roller 39, which will be explained later. This bearing hole 97 is of U shape seen from a side and is provided with an opening at the back end portion, so that the roller shaft 55 of the developing roller 39 can be taken in through the opening.

The seal arrangement portion 96 is provided adjacent to the longitudinal inside of the opening 41 with respect to the support plate portion 95, and has a roller opposed face 98 which faces the axial end portion of the roller 56 of the developing roller 39, which will be explained later, and the lower end portion of a leaf spring member 57 of the blade unit 40, which will be explained later, and is formed in an inflected manner along the outer surface of the roller 56. Moreover, a recess 99 for taking in a roller shaft 53 of the feed roller 38, which will be explained later, is formed in the vertically middle of the seal arrangement portion 96 so as to sink in obliquely forward.

Moreover, as shown in FIG. 2, the front wall 79 is provided with a handle 49, which extends forward from the connected portion with the upper wall 42 and is further folded downward, to be gripped in order to attach and detach the developing cartridge 26 to and from the drum cartridge 25.

In the toner holding chamber 37 which functions as a holder, toner of a positively-charged non-magnetic first component is held as developer. Used as the toner is polymer toner obtained by copolymerizing polymerizable monomer, e.g. styrene monomer such as styrene or acrylic monomer such as acrylic acid, alkyl (C1-C4) acrylate or alkyl (C1-C4) methacrylate, by a known polymerization method such as suspension polymerization. Such polymer toner is of spherical shape and has extremely favorable fluidity, and it is possible to achieve high-quality image formation.

It should be noted that coloring agent or wax etc. such as carbon black is compounded in such toner and addition agent such as silica is added in order to enhance the fluidity. The particle diameter thereof is approximately 6-10 μm.

Moreover, an agitator 50 for stirring toner in the toner holding chamber 37 is provided in the toner holding chamber 37. The agitator 50 is supported at a rotating shaft 51, which extends in the width direction, at a center portion of the toner holding chamber 37, and toner in the toner holding chamber 37 is stirred and discharged backward from a communication port 52 between the partition plate 45 and the lower wall 43 when the agitator 50 is rotated on the rotating shaft 51 as the supporting point.

The feed roller 38 is arranged obliquely below the back side of the communication port 52 and is supported between the pair of sidewalls 44 of the case 36 so as to be rotatable.

This feed roller 38 is constructed by coating the roller shaft 53 made of metal with a roller 54 made of conductive foamed material.

The developing roller 39 is arranged along the width direction at the opening 41 behind the feed roller 38 and is supported between the support plate portions 95 of the pair of sidewalls 44 of the case 36 so as to be rotatable. Moreover, the developing roller 39 faces and comes in contact with the photoconductor drum 28 in the anteroposterior direction with a portion of the surface thereof being arranged so as to be projected and exposed backward from the opening 41 of the case 36 and with the developing cartridge 26 being mounted to the drum cartridge 25. This developing roller 39 is constructed by coating the roller shaft 55 made of metal with the roller 56 made of conductive rubber material. The roller 56 of the developing roller 39 is provided with the surface of a roller layer made of conductive urethane rubber or silicone rubber including carbon fine particles etc., which is coated with a coat layer made of urethane rubber or silicone rubber including fluorine. Moreover, the roller 56 of the developing roller 39 is arranged and come in contact with the roller 54 of the feed roller 38 so as to be compressed by each other.

The feed roller 38 is rotated in the counterclockwise direction so that a portion to come in contact with the developing roller 39 is rotated from above to below as shown by the arrow. The developing roller 39 is rotated in the counterclockwise direction so that a portion to be exposed from the case 36 is rotated from above to below as shown by the arrow.

The blade unit 40 comprises: the leaf spring member 57 as a blade; the bend preventing member 58 as a first supporting member that is supporting means and a reinforcing plate 59 as a second supporting member that is supporting means, for supporting the leaf spring member 57; two assembly screws 94 which function as a first fastening member and a second fastening member for fastening them to each other; and seal washers 84, as shown in FIGS. 4 to 7. Each member composing the blade unit 40 is made of metal which is hard material. The metal used here at least has hardness higher than later-described sponge sealing members 92. As described later, this blade unit 40 is attached to the blade attachment unit 46 so that the reinforcing plate 59 faces and comes in contact with the front attachment portion 48 with the leaf spring member 57 being interposed between the bend preventing member 58 and the reinforcing plate 59.

The leaf spring member 57 is made of thin leaf spring material of metal and is formed to have a rectangular shape having substantially the same width as the axial width of the roller 56 of the developing roller 39. The upper end portion of this leaf spring member 57 is interposed between the bend preventing member 58 and the reinforcing plate 59. Moreover, a pressing rubber member 60 having a rectangular section made of insulating silicone rubber is formed at the lower end portion of the leaf spring member 57 so as to extend in the longitudinal direction of the leaf spring member 57. It should be noted that pressing rubber member 60 is not provided at the longitudinal end portions of the leaf spring member 57, so that the upper end portion of the later-described felt sealing member 93 can be applied to the longitudinal end portion of the leaf spring member 57.

It should be noted that the longitudinal end portions of the leaf spring member 57 are provided with insertion holes (which are not illustrated in the figure), through which the respective assembly screws 94 are inserted, formed at positions facing later-described thread groove holes 80 in the anteroposterior direction so as to run through the thickness direction. Each of the insertion holes is arranged medial to the edges of the pressing rubber member 60 in the longitudinal direction of the leaf spring member 57. Moreover, attachment holes 81 for inserting the later-described attachment screws 100 are formed lateral to the respective insertion holes in the longitudinal direction of the leaf spring member 57 so as to run through the thickness direction. Each of the attachment holes 81 is formed at a position corresponding, in the anteroposterior direction, to each tapped hole 83 formed at the front attachment portion 48 of the blade attachment unit 46.

Figure 8:
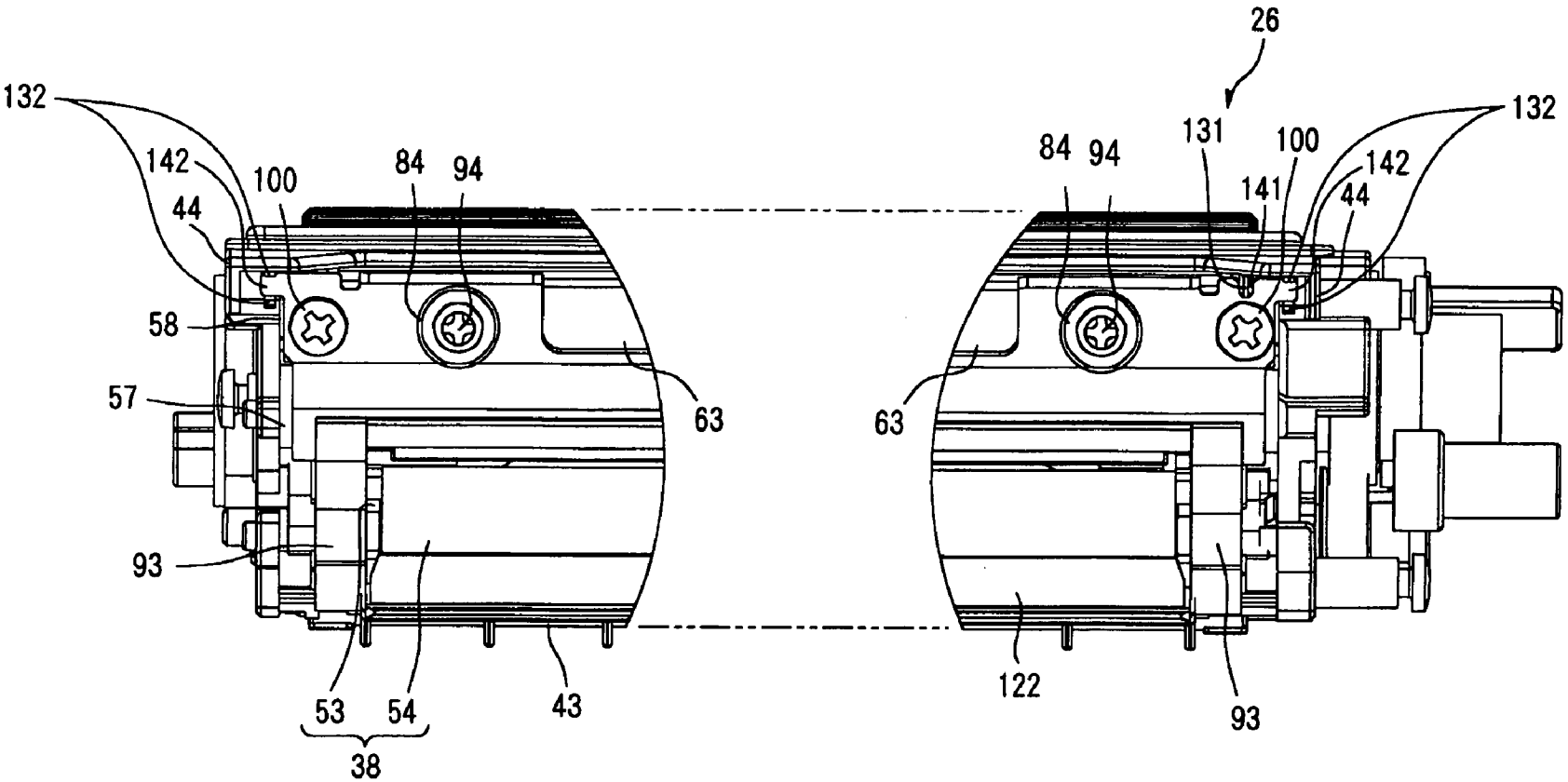
FIG. 8 is a rear view showing the structure of longitudinal end portions of the developing cartridge shown in FIG. 2.

The bend preventing member 58 has an L-shaped side section, extends in the longitudinal direction of the leaf spring member 57 and is arranged opposite to the upper end portion of the surface of the leaf spring member 57. This bend preventing member 58 integrally comprises: a rectangular plate-like contact portion 61 to come in contact with the surface of the leaf spring member 57; an extended portion 62 which functions as a reinforcing portion extending backward from the upper edge of the contact portion 61 in a state where the blade unit 40 is attached to the blade attachment unit 46; and two grippers 63 extending downward from the back end portion (free end portion in the extension direction) of the extended portion 62. Furthermore, the bend preventing member 58 has a groove 141 and protrusions 142 to be engaged with the positioning ribs 131 and 132 of the front attachment portion 48 as described above, at the longitudinal end portions of the end portion thereof. As shown in FIG. 8, when the positioning rib 131 is inserted into the groove 141, the blade unit 40 is positioned in the longitudinal direction of the opening 41. When the protrusions 142 are interposed between the positioning ribs 132 from the vertical direction, the blade unit 40 is positioned in the vertical direction of the opening 41.

The extended portion 62 comprises: end extended parts 64 having a first width, which extend from the longitudinal end portions of the upper edge of the contact portion 61; and a central extended part 65 which is provided between these end extended parts 64, has a second width larger than the first width, and extends from the longitudinal center portion of the upper edge of the contact portion 61. In other words, the extended portion 62 extends backward from the longitudinal entire area of the upper edge of the contact portion 61 and has notch portions 66 at the longitudinal end portions thereof.

The two grippers 63 respectively extend obliquely backward and downward with respect to the central extended part 65 from the longitudinal end portions of the central extended part 65 and are formed to have a rectangular shape seen from the backside.

It should be noted that insertion holes (which are not illustrated in the figure) to which the respective assembly screws 94 are inserted are formed to run through the thickness direction at positions of the longitudinal end portions of the contact portion 61, which face the respective end extended parts 64 in the vertical direction and face the later-described thread groove holes 80 in the anteroposterior direction. Moreover, attachment holes 81 corresponding to the respective attachment holes 81 of the leaf spring member 57 are formed to run through the thickness direction lateral to the respective insertion holes in the longitudinal direction of the contact portion 61.

The reinforcing plate 59 is made of an elongated rectangular metal plate, extends along the longitudinal direction of the leaf spring member 57 and is formed to be shorter than the interval between the attachment holes 81 of the leaf spring member 57. This reinforcing plate 59 is arranged at a position of the backside of the leaf spring member 57, which faces the contact portion 61 of the bend preventing member 58 with the leaf spring member 57 being interposed therebetween, so that the lower surface thereof has the same face in the vertical direction as the lower surface of the contact portion 61. Moreover, the reinforcing plate 59 is formed to have a width slightly smaller than the width (width in the vertical direction) of the contact portion 61 of the bend preventing member 58. This reinforcing plate 59 supports the upper end portion of the leaf spring member 57 between the bend preventing member 58 and the reinforcing plate 59, so as to further reinforce the leaf spring member 57. Moreover, the thread groove holes 80 to which the respective assembly screws 94 are screwed are formed at the longitudinal end portions of the reinforcing plate 59.

Each of the assembly screws 94 integrally comprises a screw head 85 and a screw shaft 86 which extends from this screw head 85. Each of the assembly screws 94 fastens the bend preventing member 58 and reinforcing plate 59 and the leaf spring member 57 interposed therebetween to each other, by inserting the screw shaft 86 into an insertion hole (which is not illustrated in the figure) formed at each of the longitudinal end portions of the bend preventing member 58 and the leaf spring member 57 from the bend preventing member 58 side with the upper end portion of the leaf spring member 57 being interposed between the bend preventing member 58 and the reinforcing plate 59, and by screwing the screw shaft 86 into the thread groove hole 80 formed at each of the end portions of the reinforcing plate 59 with the screw head 85 facing the contact portion 61.

It should be noted that the leaf spring member 57, the bend preventing member 58 and the reinforcing plate 59 are fastened to each other only by the two assembly screws 94.

Each of the seal washers 84 is made of rubber material and is formed to have an annular plate-like shape to which the screw shaft 86 of the assembly screw 94 can be inserted. In assembling with the assembly screws 94 described above, each of the seal washers 84 is interposed between the screw head 85 of the assembly screw 94 and the contact portion 61 of the bend preventing member 58 by inserting the screw shaft 86 of the assembly screw 94 into the seal washer 84 and then inserting the screw shaft 86 into the bend preventing member 58, the leaf spring member 57 and the reinforcing plate 59. Since the seal washer 84 is interposed, it is possible to seal the space between the screw head 85 of the assembly screw 94 and the contact portion 61 of the bend preventing member 58 and to prevent leakage of toner, which enters between the screw shaft 86 and the thread groove hole 80, from between the screw head 85 and the contact portion 61.

The blade unit 40 is attached to the blade attachment unit 46 so that the extended portion 62 of the bend preventing member 58 faces the upper attachment portion 47 at a distance and the reinforcing plate 59 faces and comes in contact with the front attachment portion 48, as shown in FIG. 2.

In attachment of this blade unit 40, as shown in FIG. 8, the blade unit 40 is fastened to the blade attachment unit 46 by inserting the attachment screws 100 as an attachment member into the respective attachment holes 81 of the contact portion 61 and the leaf spring member 57 and screwing the attachment screws 100 into the tapped holes 83 of the blade attachment unit 46.

Figure 4:
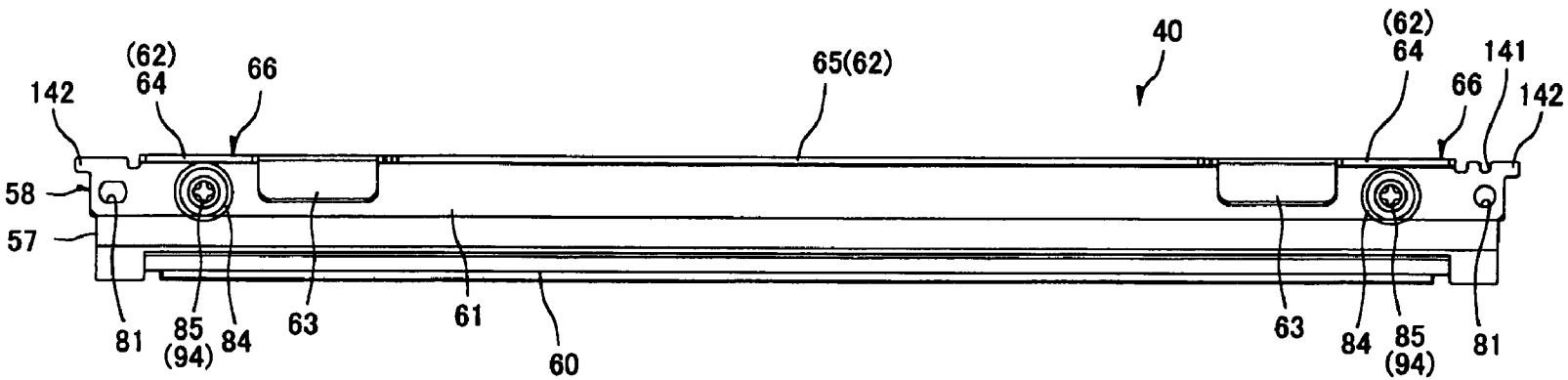
FIG. 4 is a rear view of a blade unit shown in FIG. 2.
Figure 5:
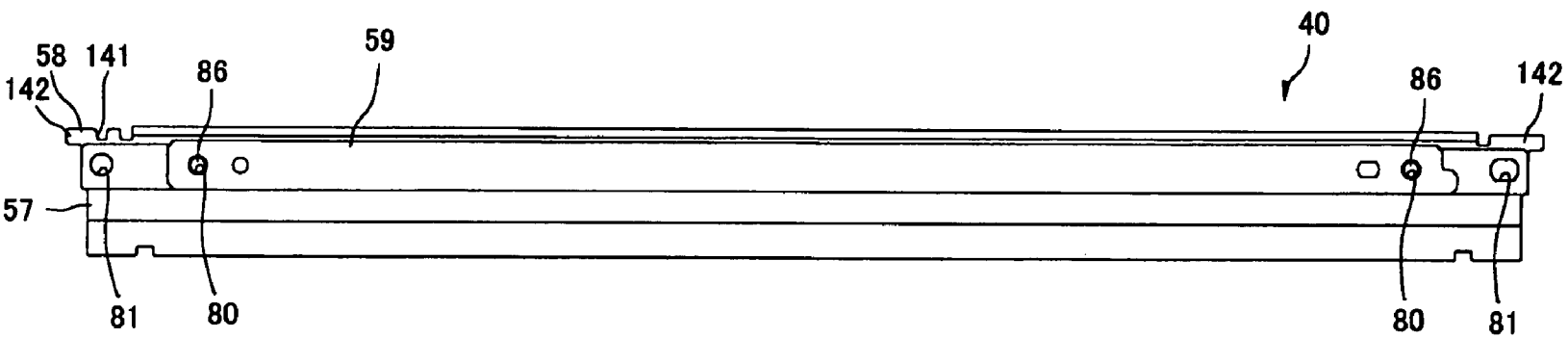
FIG. 5 is a front view of the blade unit shown in FIG. 2.
Figure 6:
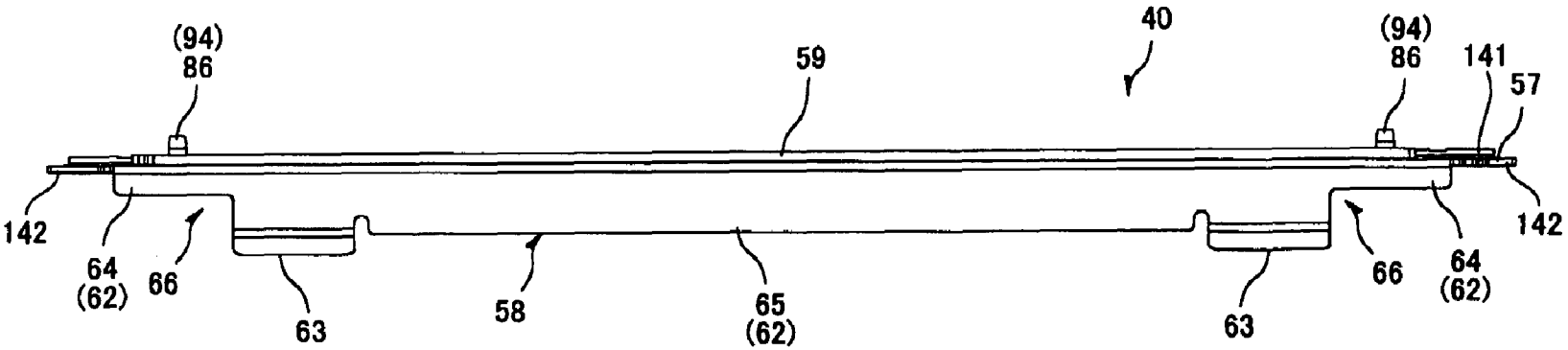
FIG. 6 is a plan view of the blade unit shown in FIG. 2.
Figure 7:
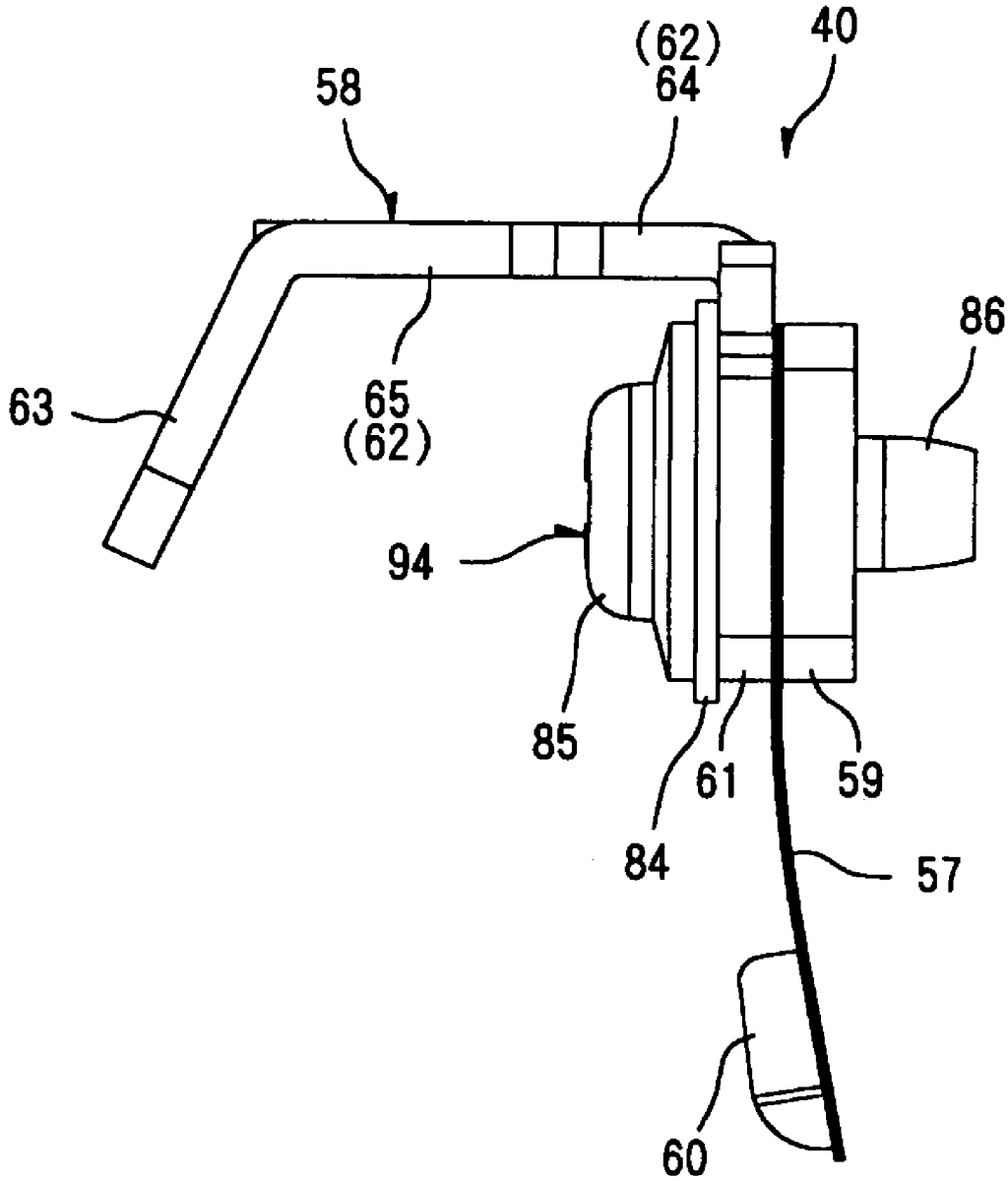
FIG. 7 is a side view of the blade unit shown in FIG. 2.

It should be noted that, of the respective attachment holes 81 of the leaf spring member 57 and the contact portion 61, one attachment hole 81 is formed to be a circular hole corresponding to the major diameter of the screw shaft of the attachment screw 100 and the other attachment hole 81 is formed to be a long hole slightly elongated in the longitudinal direction of the contact portion 61, the leaf spring member 57 and the reinforcing plate 59, as shown in FIGS. 4 and 5. By forming one attachment hole 81 to be a long hole, it is possible to allow a tolerance of the formation position of the attachment hole 81 in the longitudinal direction and to attach the blade unit 40 to the blade attachment unit 46 easily.

Moreover, in attachment of the blade unit 40 to the blade attachment unit 46, since the point portions of the screw shafts 86 of the assembly screws 94 projected from the reinforcing plate 59 enter the recesses 82 of the front attachment portion 48, it is possible to prevent collision between the point portions of the screw shafts 86 and the front attachment portion 48. It is therefore possible to make the reinforcing plate 59 come in contact with the front attachment portion 48 without generation of a clearance.

Furthermore, in attachment of the blade unit 40, since the blade unit 40 can be positioned at the blade attachment unit 46 by gripping the grippers 63 from the notch portions 66, it is possible to attach the blade unit 40 to the blade attachment unit 46 easily.

In a state where the blade unit 40 is attached to the blade attachment unit 46, the lower end portion of the leaf spring member 57 faces the roller 56 of the developing roller 39 from the front side and the pressing rubber member 60 applies pressure welding against the roller 56 by elastic force of the leaf spring member 57.

Moreover, in a state where the blade unit 40 is attached to the blade attachment unit 46, the bend preventing member 58 is arranged at the exposure side (back side) of the leaf spring member 57 where the developing roller 39 is exposed from the opening 41 and the extended portion 62 is arranged so as to extend backward.

Toner discharged from the communication port 52 to the back side internal space of the case 36 by the rotation of the agitator 50 is supplied onto the roller 56 of the developing roller 39 by the rotation of the feed roller 38 and, at this time, is positively charged by frictional electrification between the roller 54 of the feed roller 38 and the roller 56 of the developing roller 39. Toner supplied onto the roller 56 of the developing roller 39 enters the space between the pressing rubber member 60 of the blade unit 40 and the roller 56 of the developing roller 39 with the rotation of the developing roller 39, is further discharged by frictional electrification here, forms a thin layer having a constant thickness and is retained on the roller 56 of the developing roller 39.

It should be noted that, regarding this developing cartridge 26, the vertical interval D1 between the lower edge of the leaf spring member 57 and the uppermost position of the roller 54 of the feed roller 38 is smaller than or equal to 2 mm, and it is possible to carry toner charged between the roller 54 of the feed roller 38 and the roller 56 of the developing roller 39 to the position of the pressing rubber member 60 immediately and to eliminate the need for high charge of toner due to such an interval D1. Moreover, the vertical interval D2 between the lower edge of the reinforcing plate 59 (contact portion 61 of the bend preventing member 58) and the uppermost position of the roller 54 of the feed roller 38 is larger than or equal to 15 mm, and it is possible to feed toner in the toner holding chamber 37 to the developing roller 39 side smoothly due to such an interval D2.

On the other hand, as shown in FIG. 1, the surface of the photoconductor drum 28 is positively charged uniformly by the scorotron charger 29 and then exposed to light by rapid scanning of a laser beam from the scanner unit 17, so that an electrostatic latent image based on image data is formed.

Next, by the rotation of the developing roller 39, toner which is retained on the developing roller 39 and is positively charged is supplied to an electrostatic latent image formed on the surface of the photoconductor drum 28, i.e. an exposure portion of the surface of the photoconductor drum 28 positively discharged uniformly which is exposed to light by a laser beam and has lowered potential, when facing and coming in contact with the photoconductor drum 28 and is retained selectively, so that image visualization is achieved and therefore a toner image is formed by reversal development.

Then, the photoconductor drum 28 and the transfer roller 30 are driven to rotate so as to convey a paper sheet 3 interposed therebetween and the paper sheet 3 is conveyed between the photoconductor drum 28 and the transfer roller 30, so that a toner image retained on the surface of the photoconductor drum 28 is transferred onto the paper sheet 3.

It should be noted that paper powder attached to the surface of the photoconductor drum 28 by contact with the paper sheet 3 is removed by a brush of the cleaning brush 31 after transferring, when the surface of the photoconductor drum 28 faces the brush with the rotation of the photoconductor drum 28.

The fixing unit 19 is provided behind the process cartridge 18 and comprises a fixing frame 67, and a heating roller 68 and a pressing roller 69 in this fixing frame 67.

The heating roller 68 comprises a metal raw tube and a halogen lump for heating in the metal raw rube and is driven to rotate by input of power from a motor which is not illustrated in the figure.

The pressing roller 69 is arranged opposite below the heating roller 68 so as to press the heating roller 68. This pressing roller 69 is constructed by coating a roller shaft made of metal with a roller made of rubber material and is driven to follow the rotation drive of the heating roller 68.

Toner transferred onto the paper sheet 3 applies heat fusing at the fixing unit 19 when the paper sheet 3 is conveyed between the heating roller 68 and the pressing roller 69. The paper sheet 3 to which toner is fixed is conveyed to a delivery path 70 which extends in the vertical direction toward the upper surface of the body casing 2. The paper sheet 3 conveyed to the delivery path 70 is delivered onto a discharge tray 72 formed on the upper surface of the body casing 2, by a delivery roller 71 provided at the upper end thereof.

Figure 9:
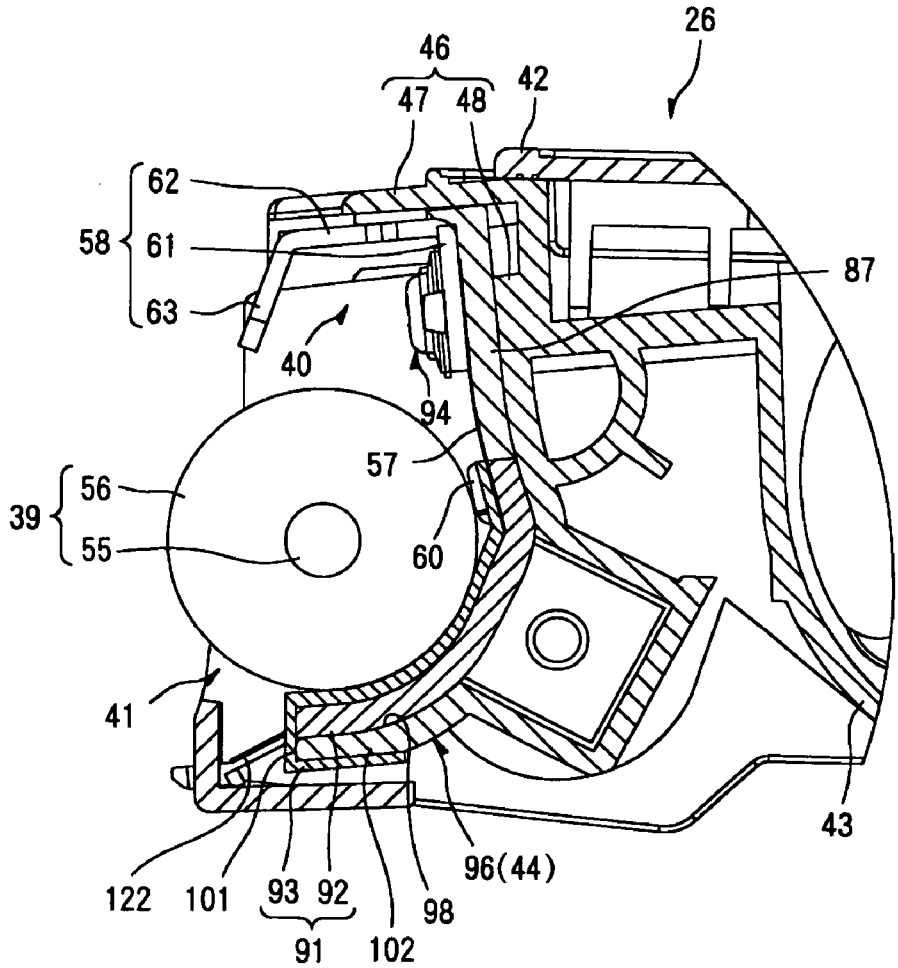
FIG. 9 is a sectional side view showing the structure of an opening of the case of the developing cartridge shown in FIG. 2.

Moreover, at this developing cartridge 26, a blade back seal 87 which functions as a second sealing member for sealing the space between the leaf spring member 57 and bend preventing member 58 and the front attachment portion 48 and seal arrangement portion 96 is interposed between the leaf spring member 57 and bend preventing member 58 of the blade unit 40 and the front attachment portion 48 of the blade attachment unit 46 and seal arrangement portions 96 of the respective sidewalls 44, as shown in FIG. 9.

Figure 10:
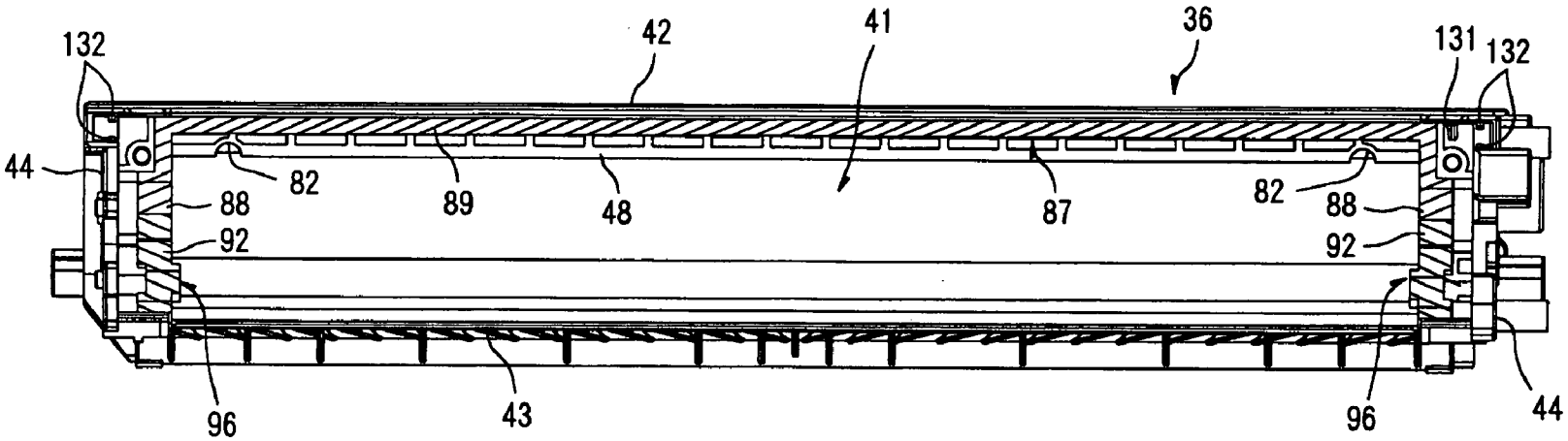
FIG. 10 is a rear view showing a state where a blade back seal and a side seal are applied to the opening of the case of the developing cartridge shown in FIG. 2.
Figure 11:
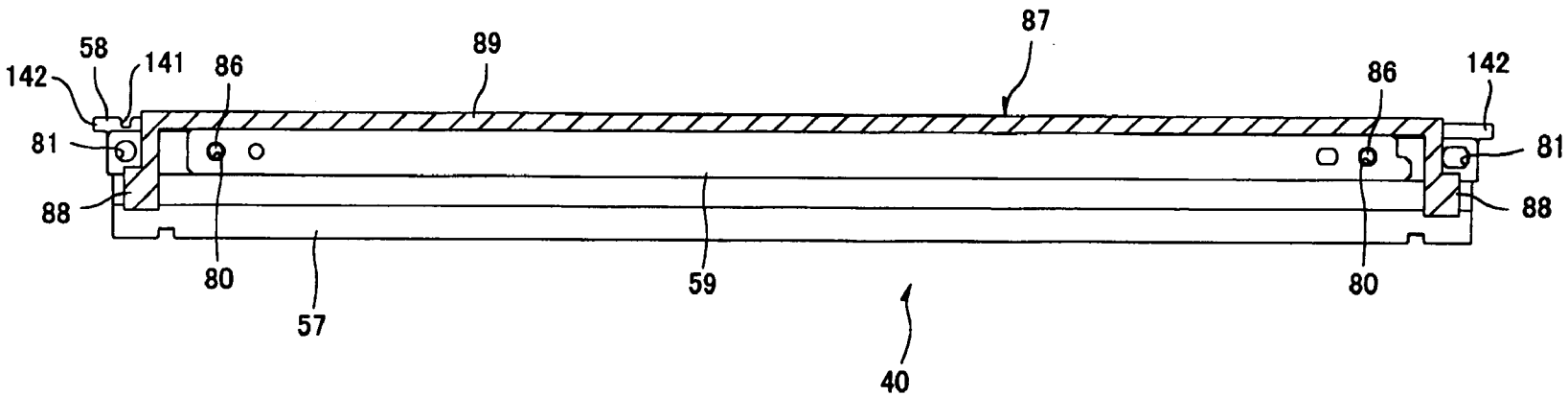
FIG. 11 is a front view for explaining the application position of the blade back seal and the side seal shown in FIG. 10.

The blade back seal 87 is made of sponge material such as urethane foam and, as shown in FIG. 10, integrally comprises the seal side portions 88 arranged at the upper portions of the roller opposed faces 98 of the seal arrangement portions 96 of the respective sidewalls 44 and a seal connecting portion 89, which extends along the upper edge of the front attachment portion 48 of the blade attachment unit 46, for connecting the seal side portions 88. In a state where the blade unit 40 is attached to the blade attachment unit 46, as shown in FIG. 11, the seal side portions 88 of the blade back seal 87 come in contact with the back surface side of the leaf spring member 57 respectively at the longitudinal sides of the reinforcing plate 59 and the seal connecting portion 89 comes in contact with the back surface side of the bend preventing member 58 at the upper side of the reinforcing plate 59. It is therefore possible to attach the blade unit 40 to the blade attachment unit 46 without interposing the blade back seal 87 between the reinforcing plate 59 and the front attachment portion 48 and seal arrangement portions 96 of both sidewalls 44.

Moreover, in a state before the blade unit 40 is attached to the blade attachment unit 46, the blade back seal 87 has a thickness larger than the thickness of the reinforcing plate 59 in the anteroposterior direction (direction crossing the leaf spring member 57). When the blade unit 40 is attached to the blade attachment unit 46, the blade back seal 87 is pressed to the front attachment portion 48 of the blade attachment unit 46 and the seal arrangement portions 96 of sidewalls 44 by the leaf spring member 57 and the bend preventing member 58 and is compressed in the opposed direction of the leaf spring member 57 and bend preventing member 58 and the front attachment portion 48 and seal arrangement portions 96, so as to elastically press respectively the leaf spring member 57, the bend preventing member 58, the front attachment portion 48 and the seal arrangement portions 96.

Since this blade back seal 87 is provided, it is possible to seal the space between the leaf spring member 57 and the longitudinal end portions of the front attachment portion 48 by the respective seal side portions 88 and to seal the space between the bend preventing member 58 and the front attachment portion 48 by the seal connecting portion 89. It is therefore possible to prevent toner entering the back surface of the leaf spring member 57 from climbing over the upper end portion of the leaf spring member 57 from the back surface and going round to above the bend preventing member 58, and to reliably prevent leakage from between the blade unit 40 and the upper attachment portion 47 of the blade attachment unit 46.

It should be noted that the blade back seal 87 is applied to the blade attachment unit 46 and the seal arrangement portions 96 with double-sided tape before the blade unit 40 is attached to the blade attachment unit 46. For example, the blade back seal 87 can be applied to the blade attachment unit 46 and the seal arrangement portions 96 by applying one face of the double-sided tape to the blade back seal 87 and then applying the other face of the double-sided tape to the blade attachment unit 46 and the seal arrangement portions 96. At this time, when double-sided tape including polyethylene terephthalate as the medium, which has high nerve, is used, it is possible to prevent deformation (elongation) of the blade back seal 87 even when relatively large force is applied to the blade back seal 87. It is therefore possible to apply the blade back seal 87 accurately.

Moreover, as shown in FIGS. 9 and 10, this developing cartridge 26 is provided with the side seals 91, which function as a first sealing member for preventing leakage of toner from the axial end portions of the developing roller 39, arranged at the lower portions of the roller opposed faces 98 of the seal arrangement portions 96 of the respective sidewalls 44.

The side seals 91 are provided so as to be frictioned with the surface of the roller 56 at the axial end portions of the roller 56 of the developing roller 39. Each of the side seals 91 comprises the sponge sealing member 92 which functions as the base and the felt sealing member 93 which functions as a friction member to be laminated on the sponge sealing member 92.

Figure 12:
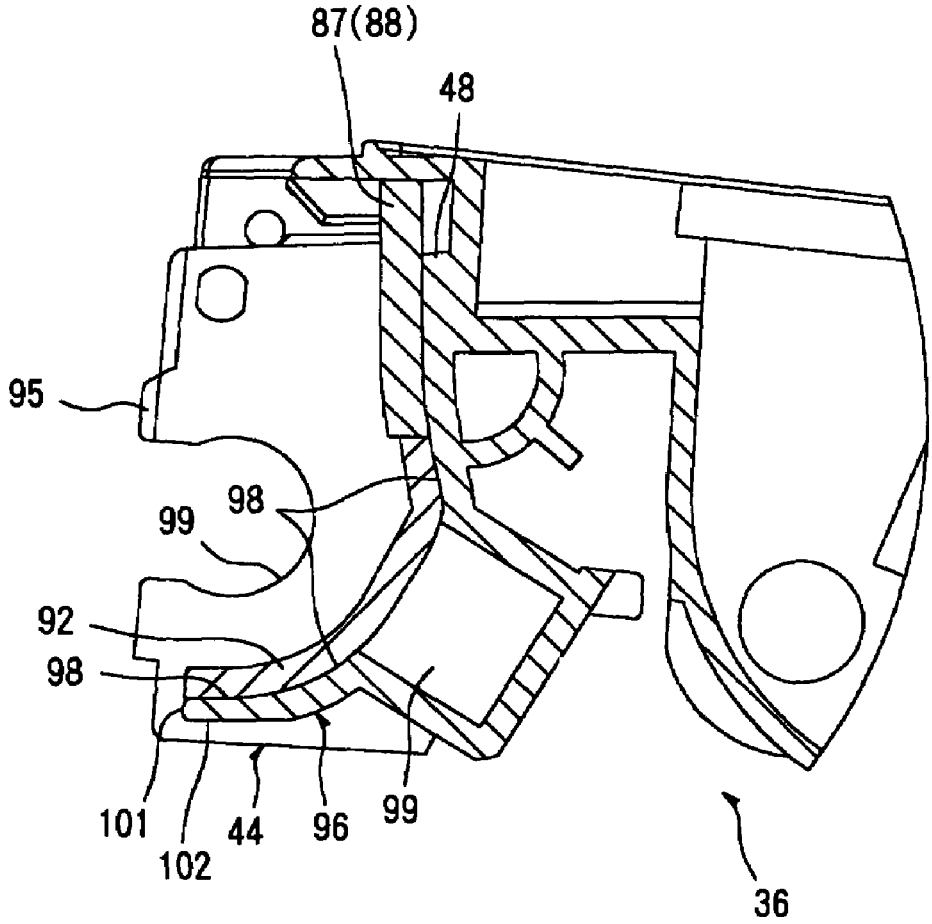
FIG. 12 is a sectional side view showing a state of the opening before the blade unit shown in FIG. 10 is attached.

The sponge sealing member 92 is made of sponge material such as urethane foam, in particular sponge material (trade name: Poron, manufactured by Rogers Inoac Corporation) having relatively high rigidity among sponge materials, and has an elastic modulus (which denotes a pressure of 12,000 Pa when compressed by 25%, for example) larger than the elastic modulus (which denotes a pressure of 2,000 Pa when compressed by 25%, for example) of the blade back seal 87. Moreover, as shown in FIG. 12, the sponge sealing member 92 is formed to have a thickness (3 mm, for example) smaller than the thickness (4 mm, for example) of the blade back seal 87 in the opposed direction of the roller 56 of the developing roller 39, in a state before the blade unit 40 is attached to the blade attachment unit 46.

Figure 13:
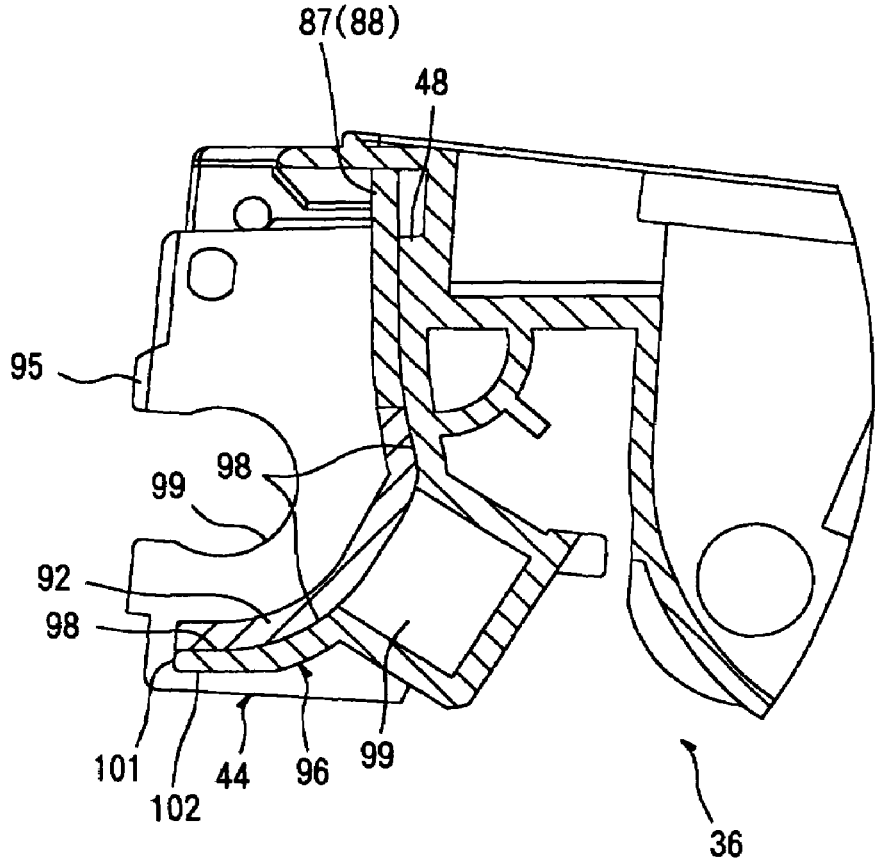
FIG. 13 is a sectional side view showing another embodiment of a state of an opening before the blade unit shown in FIG. 10 is attached.

FIG. 13 is a sectional side view showing another embodiment of a state of an opening before the blade unit is attached. As shown in FIG. 13, the sponge sealing member 92 is formed to have a thickness equal to the thickness of the blade back seal 87 in the opposed direction of the roller 56 of the developing roller 39, in a state before the blade unit 40 is attached to the blade attachment unit 46. Since the structure of the other portions are the same as that of the form shown in FIG. 12, the corresponding component are assigned with the same reference codes as FIG. 12 and the explanation thereof will be omitted.

This sponge sealing member 92 extends in the vertical direction along the rotative direction of the developing roller 39 above the roller opposed face 98 of the seal arrangement portion 96, and the upper end face thereof at the downstream side in the rotative direction is connected to be adjacent to the lower end face of the seal side portion 88 of the blade back seal 87 while the lower end face thereof at the upstream side in the rotative direction is arranged to have the same face in the anteroposterior direction as a back end face 101 of the seal arrangement portion 96. Moreover, the upper end portion of the sponge sealing member 92 is arranged between the leaf spring member 57 and the seal arrangement portions 96 together with the seal side portion 88 of the blade back seal 87 and is interposed therebetween. It should be noted that the sponge sealing members 92 are applied to the roller opposed faces 98 of the seal arrangement portions 96 with double-sided tape, similarly to the blade back seal 87.

The felt sealing member 93 is made of felt constituted of polyester fiber and is formed to have the same width as the width of the sponge sealing members 92 in the width direction. Moreover, the felt sealing member 93 is formed to have a thickness smaller than the thickness of the sponge sealing members 92 in the opposed direction of the developing roller 39 and the felt sealing member 93.

This felt sealing member 93 is arranged so that the upper end portion at the down stream side in the rotative direction of the developing roller 39 extends to the lower end portion of the leaf spring member 57 and the sponge sealing member 92, extends along the sponge sealing member 92, goes through the back end face 101 of the seal arrangement portion 96 and goes round to the lower face 102 of the seal arrangement portion 96. A face of the felt sealing member 93 facing the roller 56 of the developing roller 39 is a friction face to be frictioned with the roller 56. It should be noted that the felt sealing members 93 are applied from the lower end portion of the leaf spring member 57 via the sponge sealing members 92 to the lower faces 102 of the seal arrangement portions 96 with double-sided tape, similarly to the blade back seal 87.

For assembling the developing cartridge 26, the blade back seal 87 is applied to the blade attachment unit 46 and the seal arrangement portions 96 and then the sponge sealing members 92 are positioned with respect to the back end faces 101 of the seal arrangement portions 96 so that the back end faces 101 and the lower end faces of the sponge sealing members 92 at the upstream side in the rotative direction of the developing roller 39 have the same face in the anteroposterior direction and are applied onto the roller opposed faces 98 of the seal arrangement portions 96. After arrangement of the sponge sealing members 92, the blade unit 40 is attached to the blade attachment unit 46. At this time, the seal connecting portion 89 of the blade back seal 87 is pressed to the front attachment portion 48 by the upper end portion of the bend preventing member 58 of the blade unit 40, and the upper end portions of the sponge sealing members 92 are pressed to the seal arrangement portions 96 together with the seal side portions 88 of the blade back seal 87 by the longitudinal end portions of the leaf spring member 57. Then, after the felt sealing members 93 are applied from the lower end portion of the leaf spring member 57 via the sponge sealing members 92 to the lower faces 102 of the seal arrangement portions 96, the end portions of the roller shaft 55 of the developing roller 39 are taken in the bearing hole 97 of each support plate portion 95 of sidewalls 44, so that the developing roller 39 is supported between the support plate portions 95 of the sidewalls 44. At this time, portions of the sponge sealing members 92 from the center portion to the lower end portion are pressed to the seal arrangement portions 96 by the axial end portions of the roller 56 of the developing roller 39 via the felt sealing members 93. As a result, the sponge sealing members 92 are made to have a thickness equal to the thickness of the seal side portions 88 of the blade back seal 87 in the opposed direction of the roller 56 of the developing roller 39.

That is, when the blade unit 40 is attached to the blade attachment unit 46 and the developing roller 39 is supported between the support plate portions 95, the sponge sealing members 92 having a relatively large elastic modulus are compressed by a relatively small compressibility while the blade back seal 87 having a relatively small elastic modulus is compressed by a relatively large compressibility, so that the sponge sealing members 92 and the seal side portions 88 of the blade back seal 87 have the same thickness in the opposed direction of the roller 56 of the developing roller 39.

Accordingly, when the elastic modulus of the sponge sealing members 92, the elastic modulus of the blade back seal 87 and the compressibility thereof are respectively set so that a value obtained by multiplying the elastic modulus of the sponge sealing members 92 by the compressibility of the sponge sealing members 92 accords with a value obtained by multiplying the elastic modulus of the blade back seal 87 by the compressibility of the blade back seal 87, it is possible to equalize the force for pressing the blade unit 40 and the seal arrangement portions 96 by the sponge sealing members 92 and the force for pressing the blade unit 40 and the seal arrangement portions 96 by the blade back seal 87. It is therefore possible to reliably prevent leakage of toner from a clearance between the blade unit 40 and the case 36 at the opening 41 of the case 36, using the sponge sealing members 92 and the blade back seal 87 having different elasticity. Consequently, it is possible to prevent leakage of polymer toner from a clearance between the opening 41 of the case 36 and the developing roller 39 even when polymer toner having favorable fluidity is used as developer.

Moreover, since the sponge sealing members 92 and the seal side portions 88 of the blade back seal 87 have the same thickness, it is possible to prevent generation of a step between the sponge sealing members 92 and the seal side portions 88 of the blade back seal 87 and to prevent generation of a clearance between the sponge sealing members 92 and the leaf spring member 57 due to such a step. It is therefore possible to prevent leakage of toner from a clearance between the opening 41 of the case 36 and the developing roller 39 more reliably.

Moreover, the repulsive force from the sponge sealing members 92 having a large elastic modulus might cause generation of a clearance between the blade unit 40 and the sponge sealing members 92 when the blade unit 40 for pressing the sponge sealing members 92 and the blade back seal 87 has low rigidity. However, since the blade unit 40 is made of metal and has rigidity higher than the sponge sealing members 92, it is possible to prevent generation of a clearance between the blade unit 40 and the sponge sealing members 92 due to the repulsive force from the sponge sealing members 92 and to reliably press the blade back seal 87 having a small elastic modulus by the blade unit 40. It is therefore possible to prevent leakage of toner from a clearance between the blade unit 40 and the case 36 at the opening 41 of the case 36 further reliably.

Moreover, since the blade unit 40 functions also as a pressing member for pressing the sponge sealing members 92 and the blade back seal 87, it is possible to reduce the number of components of the developing cartridge 26.

Furthermore, since the sponge sealing members 92 arranged at the seal arrangement portions 96 have large elasticity, it is possible to prevent lowering of adhesion between the felt sealing members 93 and the developing roller 39 even when large torque caused by the rotation of the developing roller 39 acts on the sponge sealing members 92 via the felt sealing members 93. It is therefore possible to reliably prevent leakage of toner from the axial end portions of the developing roller 39.

Moreover, since the process cartridge 18 comprises the developing cartridge 26 capable of preventing leakage of toner from a clearance between the blade unit 40 and the case 36 at the opening 41 of the case 36, it is possible to prevent leakage of toner from the developing cartridge 26. Furthermore, in the laser printer 1 comprising such a process cartridge 18, it is also possible to prevent leakage of toner from the developing cartridge 26 or the process cartridge 18.

Figure 14:
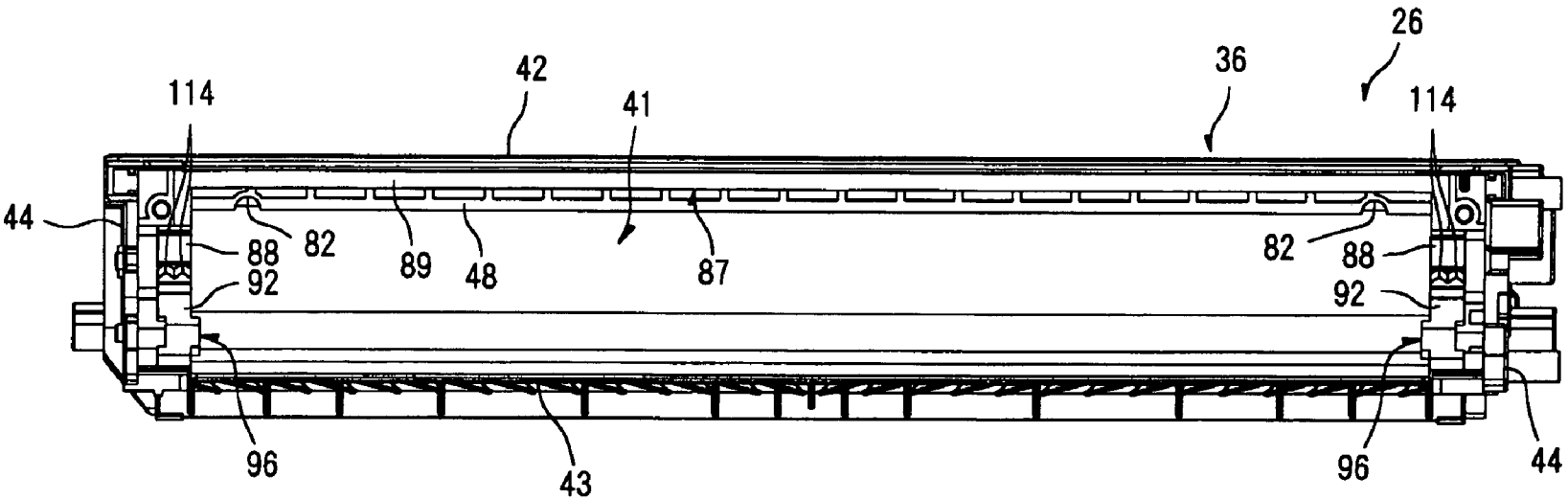
FIG. 14 is a rear view showing another embodiment (form in which the upper end portion of a sponge sealing member is overlapped with the lower end portion of a seal side portion of the blade back seal) of a developing cartridge.

FIG. 14 is a rear view showing another embodiment of the developing cartridge 26. It should be noted that portions corresponding to the above portions are assigned with the same reference codes as FIG. 14 and explanation thereof will be omitted.

Figure 15:
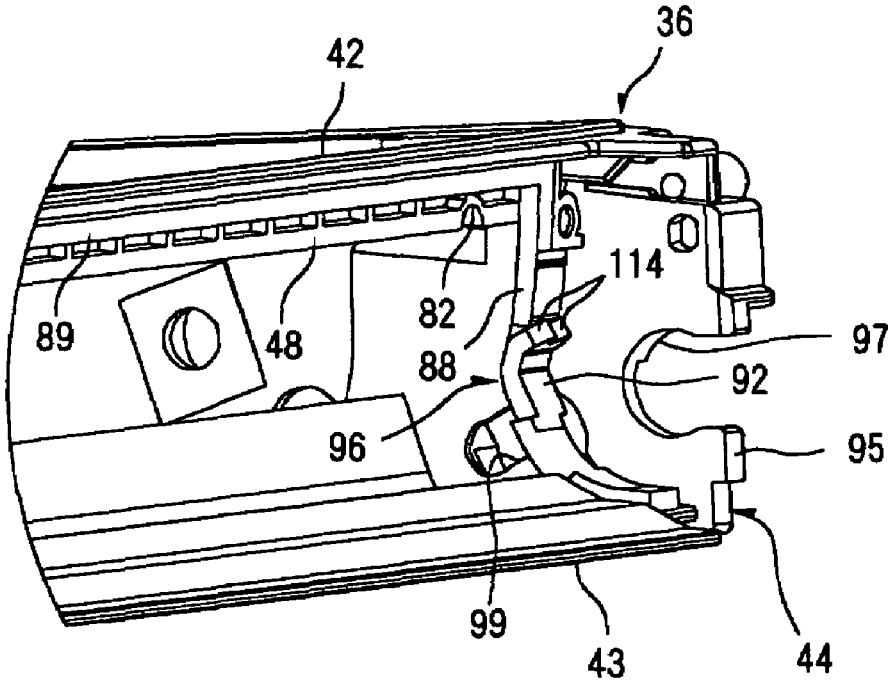
FIG. 15 is a perspective view showing the structure of one width-direction side of the developing cartridge shown in FIG. 14.
Figure 16:
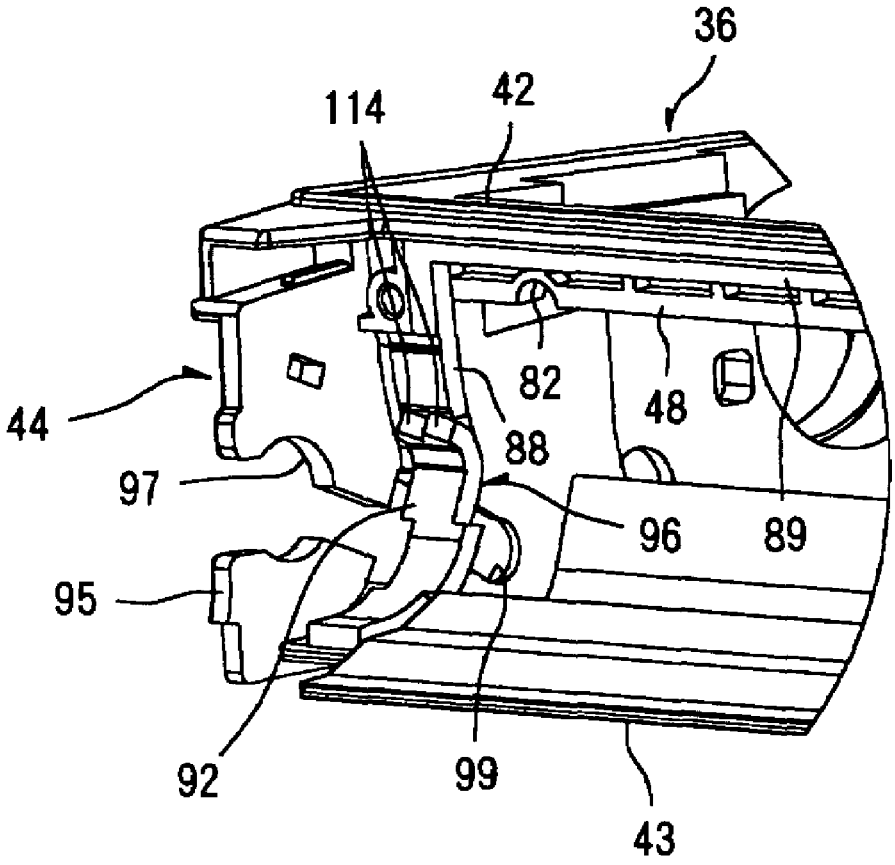
FIG. 16 is a perspective view showing the structure of the other width-direction side of the developing cartridge shown in FIG. 14.

In the developing cartridge 26 shown in FIG. 14, the upper end portions of the respective sponge sealing members 92 are arranged to be overlapped in the anteroposterior direction (direction in which the seal side portions 88 and the sponge sealing members 92 are compressed) with the lower end portions of the seal side portions 88 of the blade back seal 87 in a state before the blade unit 40 is attached to the blade attachment unit 46. As shown in FIGS. 15 and 16, the upper end portion of each of the sponge sealing members 92 is provided with two triangular plate-like protrusions 114 projected toward the lower end portion (adjacency direction of the sponge sealing members 92 and the seal side portions 88) of each of the seal side portions 88.

Figure 17A:
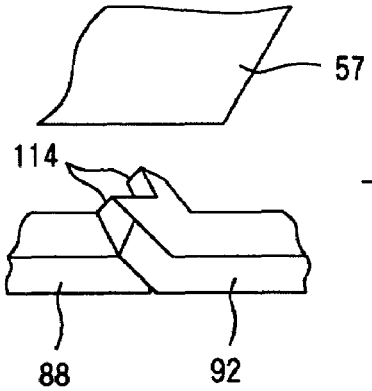
FIGS. 17A and 17B are perspective views for explaining the connection state between the blade back seal and the sponge sealing member shown in FIG. 14.

For assembling this developing cartridge 26, after the blade back seal 87 is applied to the blade attachment unit 46 and the seal arrangement portions 96, the sponge sealing members 92 are positioned so that the back end face 101 of the seal arrangement portion 96 and the lower end face of the sponge sealing member 92 at the upstream side in the rotative direction of the developing roller 39 have the same face in the anteroposterior direction as shown in FIG. 17A, extend above the roller opposed faces 98 (see FIG. 9) of the seal arrangement portions 96 and are applied so that the protrusions 114 are overlapped with the lower end portions of the seal side portions 88 of the blade back seal 87. After arrangement of the sponge sealing members 92, the blade unit 40 (see FIG. 9) is attached to the blade attachment unit 46 and the protrusions 114 of the sponge sealing members 92 are pressed toward the seal side portions 88 of the blade back seal 87 by the longitudinal end portions of the leaf spring member 57 of the blade unit 40.

Figure 17B:
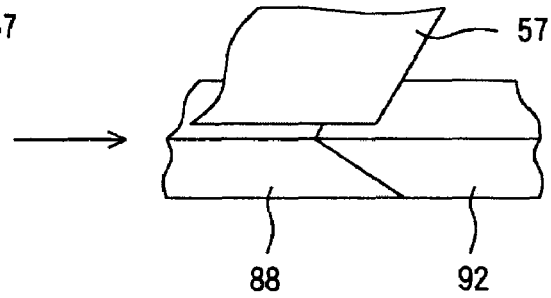

As described above, by arranging the upper end portions of the sponge sealing members 92 having a large elastic modulus on the lower end portions of the seal side portions 88 having a small elastic modulus and pressing and interposing them by the leaf spring member 57 and the seal arrangement portions 96, the lower end portions of the seal side portions 88 having a small elastic modulus can be transformed along the shape of the protrusions 114 of the upper end portions of the sponge sealing members 92 having a large elastic modulus as shown in FIG. 17B. It is therefore possible to prevent generation of a clearance at the connected portions of the seal side portions 88 and the sponge sealing members 92 and to prevent leakage of toner from the connected portions of the seal side portions 88 and the sponge sealing members 92.

Especially, since the protrusions 114 are formed at the sponge sealing members 92, the lower end portions of the seal side portions 88 is transformed along the shape of the protrusions 114 when the leaf spring member 57 presses the sponge sealing members 92 toward the seal side portions 88 of the blade back seal 87. It is therefore possible to reliably prevent generation of a clearance at the connected portions of the sponge sealing members 92 and the seal side portions 88. As a result, it is possible to reliably prevent leakage of toner from the connected portions of the sponge sealing members 92 and the seal side portions 88.

Figure 18A:
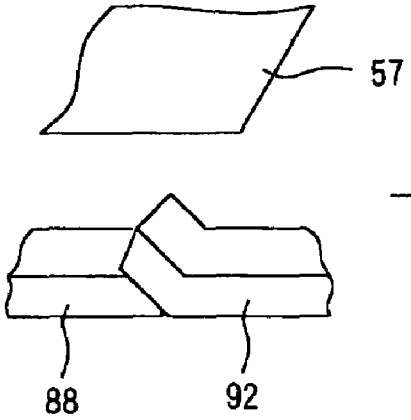
FIGS. 18A and 18B are perspective views for explaining a problem of a case where the sponge sealing member shown in FIG. 14 does not have a protrusion.
Figure 18B:
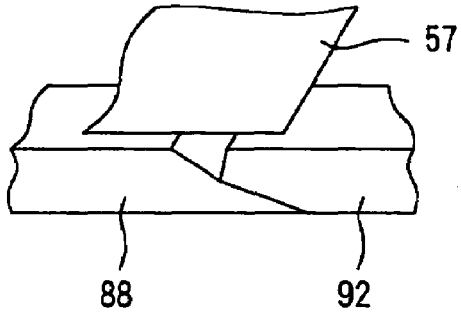

That is, when the protrusions 114 are not formed at the upper end portions of the sponge sealing members 92 as shown in FIG. 18A, a clearance might be generated at the connected portions of the seal side portions 88 and the sponge sealing members 92 as shown in FIG. 18B when the upper end portions of the sponge sealing members 92 are arranged to be overlapped with the lower end portions of the seal side portions 88 and they are pressed by the leaf spring member 57. On the other hand, in the case that the protrusions 114 are formed at the upper end portions of the sponge sealing members 92, the lower end portions of the seal side portions 88 is transformed along the shape of the protrusions 114 when the leaf spring member 57 presses the sponge sealing members 92 toward the seal side portions 88 of the blade back seal 87, so that it is possible to prevent generation of a clearance shown in FIG. 18B.

Furthermore, since overlap of the upper end portions of the sponge sealing members 92 with the lower end portions of the seal side portions 88 is allowed in arrangement of the sponge sealing members 92, it is possible to reduce the time and effort of arranging the sponge sealing members 92.

It should be noted that, although the upper end portions of the sponge sealing members 92 are arranged on the lower end portions of the seal side portions 88 of the blade back seal 87 in this embodiment, the lower end portions of the seal side portions 88 having a small elastic modulus may be arranged on the upper end portions of the sponge sealing members 92 having a large elastic modulus, by first applying the sponge sealing members 92 and then applying the blade back seal 87. In this case, the lower end portions of the seal side portions 88 can be transformed easily along the shape of the protrusions 114 of the upper end portions of the sponge sealing members 92 by pressing the end portions of the sponge sealing members 92 and the seal side portions 88 from the seal side portions 88 side having a small elastic modulus toward the seal arrangement portions 96.

Moreover, although two protrusions 114 are formed at the upper end portion of each of the sponge sealing members 92 in this embodiment, only one protrusion 114 may be formed, or three or more protrusions 114 may be formed at the upper end portions of the sponge sealing members 92. Furthermore, such a protrusion 114 may be formed at the lower end portions of the seal side portions 88.

Figure 19:
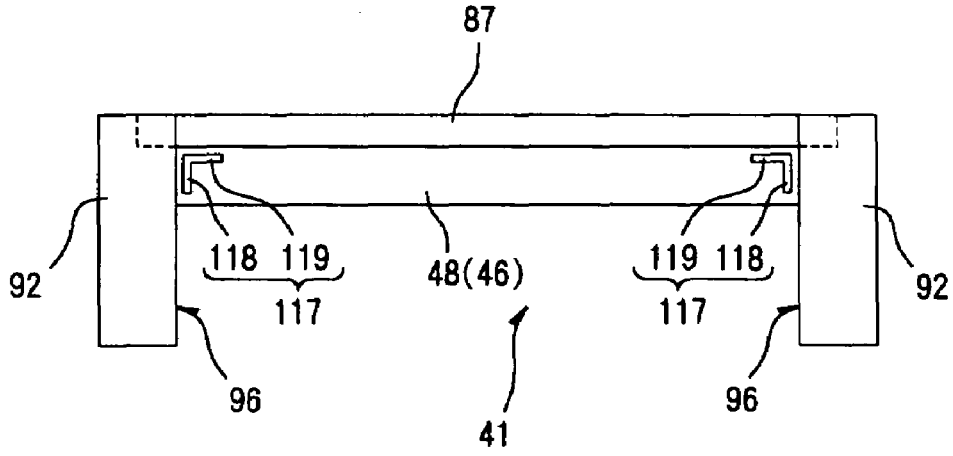
FIG. 19 is a rear view schematically showing another embodiment (form in which the blade back seal is formed to have an elongated rectangular plate-like shape and a baffle opposed to the connected portion of the blade back seal and the sponge sealing member is provided) of a blade back seal and a sponge sealing member.

FIG. 19 is a rear view schematically showing an embodiment of the blade back seal 87 and the sponge sealing members 92. It should be noted that portions corresponding to the above portions are assigned with the same reference codes as FIG. 19 and explanation thereof will be omitted.

Figure 20:
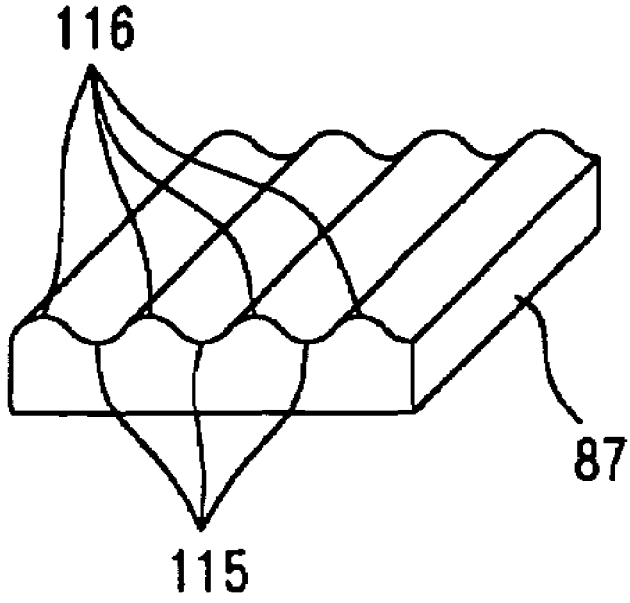
FIG. 20 is a perspective view of the blade back seal shown in FIG. 19.

The blade back seal 87 shown in FIG. 19 is made of sponge material such as urethane foam, is formed to have an elongated rectangular plate-like shape and extends along the upper edge of the front attachment portion 48 of the blade attachment unit 46 which functions as a connecting unit. Moreover, as shown in FIG. 20, the rear face (contact surface to come in contact with the leaf spring member 57) of the blade back seal 87 is provided with linear recesses 115 and linear projections 116 which extend along the longitudinal direction arranged alternately at a distance in the vertical direction crossing the longitudinal direction.

Figure 21A:
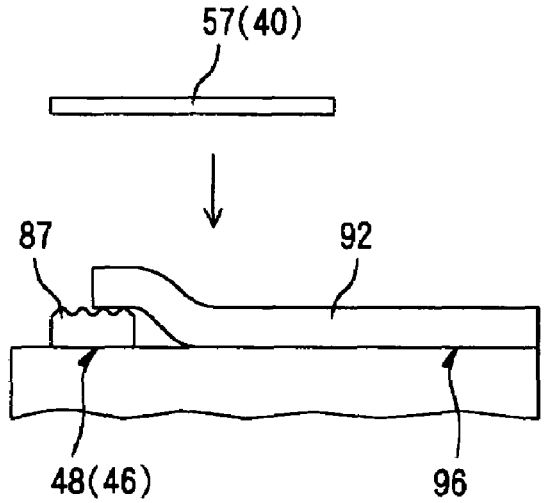
FIGS. 21A and 21B are perspective views for explaining the connection state between the blade back seal and the sponge sealing member shown in FIG. 19.

On the other hand, in a state before the blade unit 40 is attached to the blade attachment unit 46, the sponge sealing members 92 extend in the vertical direction along the rotative direction of the developing roller 39 on the roller opposed faces 98 (see FIG. 9) of the seal arrangement portions 96 which functions as a side portion, and the upper end portions of the sponge sealing members 92 at the downstream side in the rotative direction are interposed between the width-direction end portions of the blade back seal 87 and the front attachment portion 48 as shown in FIG. 21A and are arranged to be overlapped in the anteroposterior direction (direction in which the blade back seal 87 and the sponge sealing members 92 are compressed) with the width-direction end portions of the blade back seal 87. It should be noted that the upper end portions of the sponge sealing members 92 are overlapped at the lower portions of the width-direction end portions of the blade back seal 87 and the upper portions of the width-direction end portions of the blade back seal 87 are exposed from the upper end portions of the sponge sealing members 92.

Moreover, as shown in FIG. 19, the front attachment portion 48 of the blade attachment unit 46 is provided with L-shaped baffles 117, which are arranged opposite to the connected portion of the blade back seal 87 and each of the sponge sealing members 92 from inside of the opening 41, for preventing leakage of toner from the connected portion. In particular, each of the baffles 117 comprises a side baffle 118 which is projected backward from the front attachment portion 48 and extends along the sponge sealing member 92 and an upper baffle 119 which is projected backward from the front attachment portion 48 and extends in a direction that crosses the side baffle 118 and runs along the blade back seal 87.

Figure 21B:
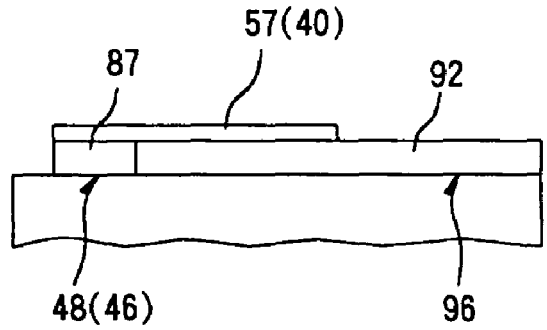

After being arranged in the above state, the blade back seal 87 and the sponge sealing members 92 are pressed by the blade unit 40 respectively toward the front attachment portion 48 and the roller opposed faces 98 of the seal arrangement portions 96 when the blade unit 40 is attached to the blade attachment unit 46. Thus, the width-direction end portions of the blade back seal 87 having a small elastic modulus are transformed along the shapes of the upper end portions of the sponge sealing members 92 having a large elastic modulus as shown in FIG. 21B, and the blade back seal 87 and each of the sponge sealing members 92 are connected without generation of a clearance at the connected portion. It is therefore possible to prevent leakage of toner from the connected portion of the blade back seal 87 and each of the sponge sealing members 92.

Furthermore, it is possible with each of the baffles 117 to prevent toner from entering the connected portion of the blade back seal 87 and each of the sponge sealing members 92. It is therefore possible to prevent leakage of toner from the connected portion of the blade back seal 87 and each of the sponge sealing members 92 more reliably.

Moreover, since the recesses 115 and the projections 116 are formed at the contact surface of the blade back seal 87 and the leaf spring member 57, pressing force by the leaf spring member 57 concentrates on the projections 116 when being pressed by the leaf spring member 57 and it is possible to enhance the adhesion between the leaf spring member 57 and the blade back seal 87 at the projections 116. It is therefore possible to enhance the sealing performance between the leaf spring member 57 and the blade back seal 87 and to prevent leakage of toner from a clearance between the opening 41 and the developing roller 39 more reliably.

Furthermore, since the recesses 115 and the projections 116 are formed in succession on the contact surface, it is possible to enhance the adhesion between the blade back seal 87 and the blade unit 40 at a region elongated in the longitudinal direction. It is therefore possible to prevent leakage of toner from a clearance between the opening 41 and the developing roller 39 further reliably.

Moreover, since the recesses 115 and the projections 116 extend in the longitudinal direction of the opening 41, i.e. a direction crossing the direction in which toner leaks from the upper end of the opening 41, it is possible to prevent leakage of toner from a clearance between the blade unit 40 and the case 36 at the opening 41 further reliably.

It should be noted that, although the recesses 115 and the projections 116 are formed at the contact surface of the blade back seal 87 with the leaf spring member 57 in this embodiment, the recesses 115 and the projections 116 may be formed at the contact surface of the blade back seal 87 with the front attachment portion 48 of the blade attachment unit 46, or may be formed at both of the contact surface of the blade back seal 87 with the blade unit 40 and the contact surface to come in contact with the front attachment portion 48. Moreover, the recesses 115 and the projections 116 may be formed at one of or both of the contact surfaces of the sponge sealing members 92 with the blade unit 40 and the contact surface to come in contact with the seal arrangement portions 96. When the recesses 115 and the projections 116 are formed at the sponge sealing members 92, they are formed in succession along a direction (i.e., direction crossing a direction in which toner leaks) crossing the longitudinal direction of the opening 41.

Moreover, the baffles 117 for preventing leakage of toner from the connected portion of the blade back seal 87 and the sponge sealing members 92 may be also provided at the developing cartridge 26 having the structure shown in FIG. 10. In this case, the baffles 117 are formed to have a plate-like shape which faces the connected portion of each of the seal side portions 88 of the blade back seal 87 and each of the sponge sealing members 92 from inside of the opening 41 and extends along the rotative direction of the developing roller 39.

In the present embodiment, the blade unit 40 having the above structure is provided with the leaf spring member 57 fastened to the bend preventing member 58 and the reinforcing plate 59 by the assembly screws 94 at the longitudinal end portions. Since the bend preventing member 58 comprises the central extended part 65 which extends backward from the longitudinal center portion of the upper edge of the contact portion 61 between the two assembly screws 94, this central extended part 65 can reinforce the leaf spring member 57 between the two assembly screws 94. It is therefore possible to prevent undulation or deflection of the leaf spring member 57. As a result, it is possible to press the surface of the roller 56 of the developing roller 39 with uniform force by the pressing rubber member 60 and to retain a thin layer of toner having a uniform thickness at the surface of the roller 56. Moreover, since the central extended part 65 to be formed integrally with the contact portion 61 functions also as a reinforcing portion for reinforcing the leaf spring member 57, it is possible to reduce the number of components of the developing cartridge 26.

Moreover, it is possible to give high rigidity to the bend preventing member 58 since the bend preventing member 58 integrally comprises the contact portion 61 and the extended portion 62, and it is possible to reliably prevent flexion of the leaf spring member 57 by making the contact portion 61 of the bend preventing member 58 in contact with the leaf spring member 57 and supporting the upper end portion of the leaf spring member 57.

Furthermore, by interposing the upper end portion of the leaf spring member 57 between the bend preventing member 58 and the reinforcing plate 59, it is possible to prevent flexion such as undulation or reflection of the leaf spring member 57 and to support the leaf spring member 57 stably.

Moreover, since the extended portion 62 (central extended part 65) is arranged so as to extend backward from the upper end portion of the contact portion 61 with respect to the leaf spring member 57, it is possible to prevent interference between the extended portion 62 and the developing roller 39.

Furthermore, since the bend preventing member 58 comprises the grippers 63, it is possible to attach the blade unit 40 to the blade attachment unit 46 easily by gripping the grippers 63. Furthermore, since the notch portions 66 are formed lateral to the grippers 63 and the extended portion 62 does not exist there, it is possible to grip the grippers 63 from the lateral side for attaching the blade unit 40 to the blade attachment unit 46.

Moreover, since the notch portions 66 are formed at portions of the extended portion 62 facing the respective assembly screws 94 in the vertical direction, i.e. the longitudinal end portions of the extended portion 62, it is possible to insert each of the assembly screws 94 into each of the insertion holes of the contact portion 61 of the bend preventing member 58 easily even from the free end portion side of the extended portion 62 and to operate the screw head 85 of each of the assembly screws 94 easily with a tool such as a driver.

Furthermore, since the side seals 91 are provided, it is possible to prevent leakage of toner from the longitudinal end portions of the developing roller 39. Furthermore, since the friction faces of the side seals 91 to be frictioned with the roller 56 of the developing roller 39 are made of felt, it is possible to reduce the friction resistance between the side seals 91 and the roller 56 of the developing roller 39 and to reliably prevent leakage of toner from the longitudinal end portions of the developing roller 39.

Moreover, the notch portions 66 are formed at the longitudinal end portions of the extended portion 62, the extended portion 62 does not obstruct application of the felt sealing members 93 and it is possible to arrange the felt sealing members 93 easily.

Furthermore, since the blade unit 40 is attached to the blade attachment unit 46 by the attachment screws 100 lateral to the two assembly screws 94 in the longitudinal direction, it is possible to prevent undulation of the leaf spring member 57 by the press of the attachment screws 100 between the two assembly screws 94 and to attach the blade unit 40 to the case 36.

Moreover, since each of the assembly screws 94 is provided medial to the edges of the pressing rubber member 60 in the longitudinal direction of the leaf spring member 57, it is possible to reliably press a portion of the pressing rubber member 60 facing each of the assembly screws 94 to the surface of the roller 56 of the developing roller 39. It is therefore possible to prevent generation of a difference between the pressing force for pressing the surface of the roller 56 by one end portion side and the pressing force for pressing the surface of the roller 56 by the other end portion side in the longitudinal direction of the pressing rubber member 60. As a result, it is possible to retain a thin layer of toner having a more uniform thickness on the roller 56.

Moreover, since the process cartridge 18 comprises the developing cartridge 26 capable of preventing flexion such as undulation or deflection of the leaf spring member 57, it is possible to retain a thin layer of toner having a uniform thickness on the surface of the roller 56 of the developing roller 39 and to supply an appropriate amount of toner to the surface of the photoconductor drum 28. With the laser printer comprising such a process cartridge 18, it is possible to form a high-quality image without undesirable shading.

Figure 22:
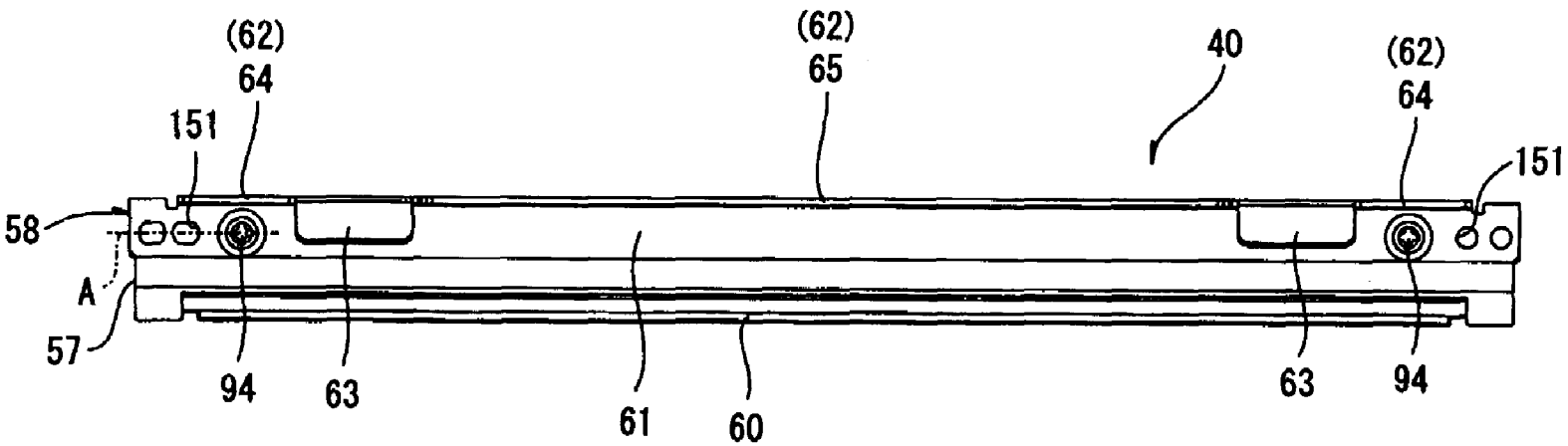
FIG. 22 is a rear view showing another embodiment (form in which a hole for positioning is provided) of a blade unit.
Figure 23:
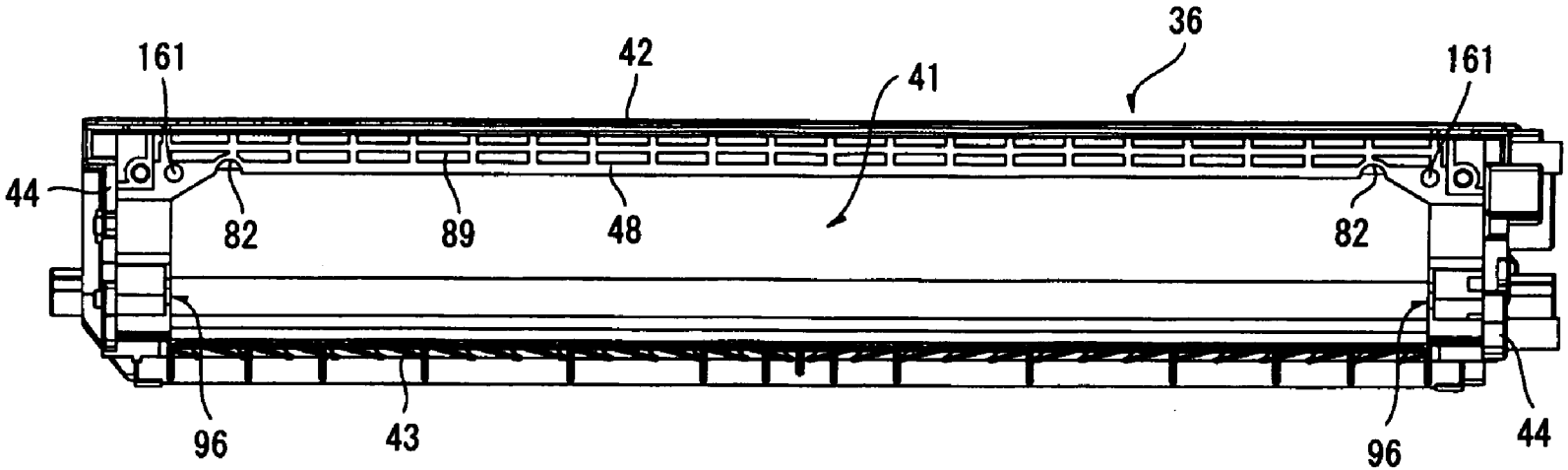
FIG. 23 is a rear view showing another embodiment (form in which a boss for positioning is provided) of a case of a developing cartridge.
Figure 24:
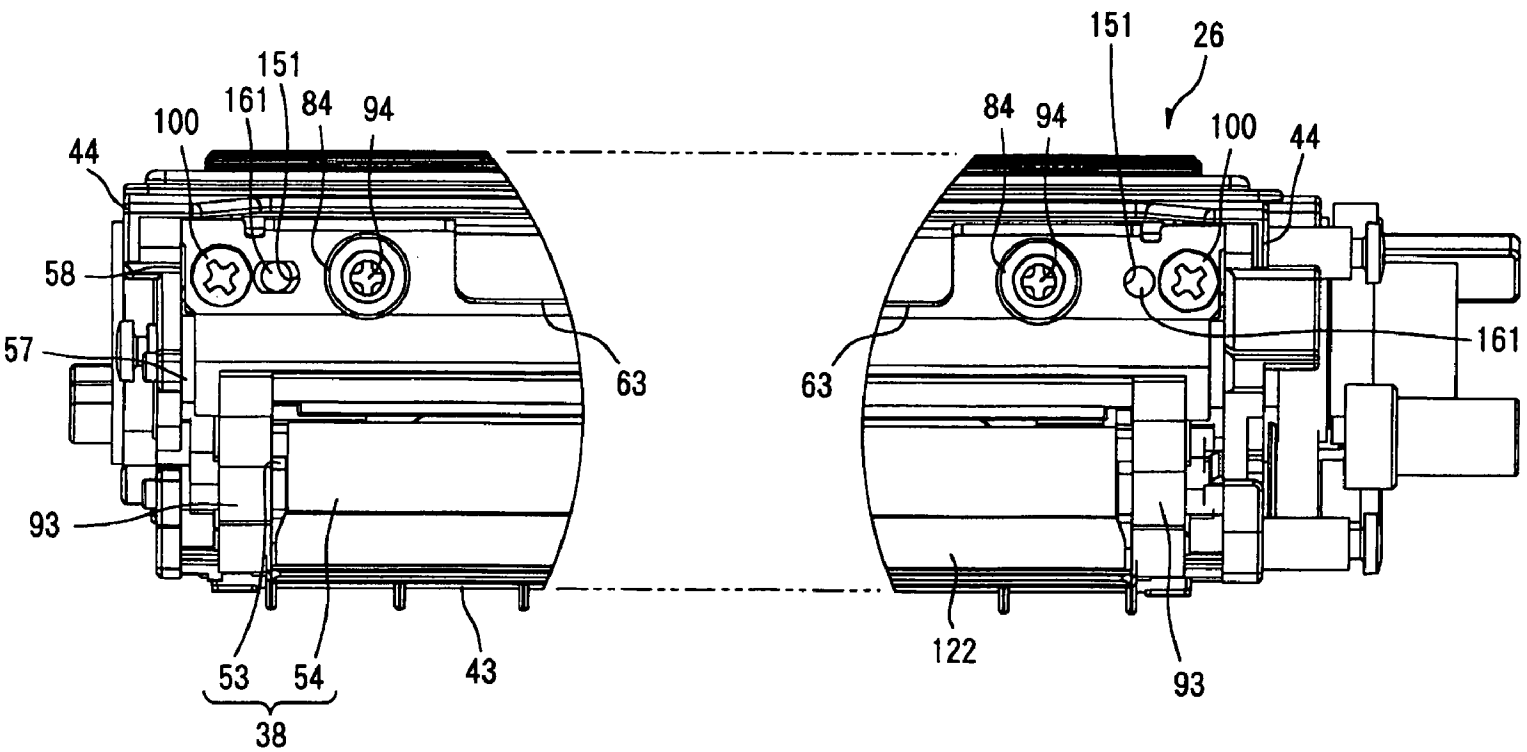
FIG. 24 is a rear view showing the structure of longitudinal end portions of a developing cartridge in a state where the blade unit shown in FIG. 22 is attached to a case of the developing cartridge shown in FIG. 23.

It should be noted that, although the positioning of the blade unit 40 with respect to the case 36 is performed by the positioning ribs 131 and 132, the groove 141 and the protrusions 142 in the present embodiment, bosses 161 and holes 151 can be used for the positioning instead of the positioning ribs 131 and 132, the groove 141 and the protrusions 142, as shown in FIGS. 22 through 24. That is, the front attachment portion 48 of the case 36 is provided with cylindrical bosses 161, which are projected from the surface of the front attachment portion 48 in the exposure direction of the developing roller 36, at the longitudinal ends of the opening 41, and the blade unit 40 is provided with holes 151 at positions corresponding to the bosses 161. In this case, the bosses 161 are preferably provided at positions lateral to the blade back seal 87 with respect to the opening 41. This is because toner leaks from a clearance between the bosses 161 and the holes 151 when the bosses 161 are provided medial to the blade back seal 87. Moreover, each of the holes 151 is provided between the insertion hole of the bend preventing member 58 to which the assembly screw 94 is inserted and the attachment hole 81 to which the attachment screw 100 is inserted, on a line A connecting them. This enables to further decrease the dimension of the process cartridge 18 in the vertical direction in comparison with a case where the holes 151 are formed with shift from the line A in the vertical direction. It should be noted that one of the holes 151 is formed to be a long hole slightly elongated in the longitudinal direction of the opening 41. It is therefore possible to allow a tolerance of the formation position of the hole 151 in the longitudinal direction.

As this description may be embodied in several forms without departing from the spirit of essential characteristics thereof, the present embodiments are therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. A developing apparatus comprising:

a case having a slit-shaped opening;

a developer retainer which is arranged along a longitudinal direction of the opening and supported by the case so as to be rotatable; and a pressing member, which is arranged at the opening of the case, for pressing a first sealing member and a second sealing member, wherein the first sealing member has a first elastic modulus and is arranged at the opening of the case and interposed between the pressing member and the case while being compressed by a first compressibility, and the second sealing member has a second elastic modulus smaller than the first elastic modulus and is arranged adjacent to the first sealing member at the opening of the case and interposed between the pressing member and the case while being compressed by a second compressibility larger than the first compressibility.

2. The developing apparatus according to claim 1, wherein the first sealing member and the second sealing member, which are compressed respectively by the first compressibility and the second compressibility by the pressing member, have the same thickness in an opposed direction of the case and the pressing member.

3. The developing apparatus according to claim 1, wherein the pressing member is made of hard material having hardness higher than the first sealing member.

4. The developing apparatus according to claim 1, wherein the pressing member is a blade unit, which has one side end portion that presses the developer retainer, for regulating a layer thickness of developer to be retained by the developer retainer.

5. The developing apparatus according to claim 1, wherein the case comprises:

a holder, which communicates with the opening, for holding developer;

two side portions which are positioned at longitudinal end portions of the opening and extend along a surface opposed to the developer retainer and the pressing member in a communication direction of the opening and the holder; and a connecting unit, which extends in a longitudinal direction of the opening in a direction that crosses a longitudinal direction of the opening and crosses the communication direction, for connecting the two side portions, and the first sealing member is arranged at the side portions, and the second sealing member is arranged at the connecting unit.

6. The developing apparatus according to claim 1, wherein the first sealing member and the second sealing member are arranged with end portions adjacent to each other being overlapped in a compression direction, and any one of the overlapped end portion of the first sealing member and end portion of the second sealing member is provided with a protrusion projected in an adjacency direction of the first sealing member and the second sealing member.

7. The developing apparatus according to claim 6, wherein the second sealing member is arranged between the case and the first sealing member.

8. The developing apparatus according to claim 1, wherein at least one of the first sealing member and the second sealing member is provided with a recess and a projection formed at at least one of a contact surface to come in contact with the case and a contact surface to come in contact with the pressing member.

9. The developing apparatus according to claim 8, wherein the recess and the projection are formed in succession on the contact surface.

10. The developing apparatus according to claim 9, wherein the recess and the projection extend in a direction which crosses a direction connecting inside of the opening and outside.

11. The developing apparatus according to claim 1, further comprising a baffle, which is arranged opposite to an adjoining portion of the first sealing member and the second sealing member from inside of the opening.

12. The developing apparatus according to claim 1, wherein the developer is polymer toner obtained by polymerizing polymerizable monomer.

13. A detachable process cartridge for an image forming apparatus, comprising a developing apparatus according to claim 1.

14. An image forming apparatus comprising a developing apparatus according to claim 1 or a process cartridge according to claim 13.

15. A developing apparatus comprising:

a case having an opening;

a developer retainer, which is arranged with a portion of surface being exposed at the opening and is supported by the case so as to be rotatable, for retaining developer at a surface thereof, a blade, which is formed to have a sheet-like shape, is disposed in a longitudinal direction of the developer retainer and has one side end portion in a direction crossing a longitudinal direction thereof that presses a surface of the developer retainer, for regulating a layer thickness of developer to be retained on a surface of the developer retainer;

a supporting unit for supporting the other side end portion of the blade along a longitudinal direction of the blade;

a first fastening member and a second fastening member for fastening the blade to the supporting unit respectively at longitudinal end portions of the blade; and a reinforcing portion, which is provided at least between the first fastening member and the second fastening member, for reinforcing the blade.

16. The developing apparatus according to claim 15, wherein the reinforcing portion is formed at the supporting unit.

17. The developing apparatus according to claim 16, wherein the supporting unit comprises a first supporting member arranged on one surface of the blade and a second supporting member arranged on the other surface of the blade, the blade is interposed between the first supporting member and the second supporting member, and the reinforcing portion is formed at the fist supporting member.

18. The developing apparatus according to claim 17, wherein the first supporting member comprises a contact portion which extends along a longitudinal direction of the blade and comes in contact with said one surface of the blade, and an extended portion which extends from an end portion opposite to the developer retainer side of the contact portion in a direction crossing said one surface of the blade, and the extended portion functions as the reinforcing portion.

19. The developing apparatus according to claim 18, wherein the first supporting member is provided at an exposure side where the developer retainer is exposed from the opening with respect to the blade, and the extended portion extends from an end portion opposite to the developer retainer side of the contact portion to the exposure side.

20. The developing apparatus according to claim 19, wherein the first supporting member comprises a gripper which extends from a free end portion in an extension direction of the extended portion in a direction crossing the extension direction.

21. The developing apparatus according to claim 18, wherein the first fastening member and the second fastening member respectively run through longitudinal end portions of the contact portion, and the extended portion comprises two end extended parts, which respectively face the first fastening member and the second fastening member in a direction crossing a longitudinal direction of the contact portion and have a first width in an extension direction, and a central extended part, which is provided between the two end extended parts and has a second width larger than the first width in an extension direction.

22. The developing apparatus according to claim 21, wherein the gripper extends at least from an end portion in a longitudinal direction of the central extended part in a direction crossing an extension direction.

23. The developing apparatus according to claim 18, wherein the extended portion extends in an extension direction from a longitudinal entire area at an end portion opposite to the developer retainer side of the contact portion and has a notch portion at longitudinal end portions thereof.

24. The developing apparatus according to claim 21, wherein the first fastening member and the second fastening member respectively comprise a screw shaft which runs through the first supporting member, the blade and the second supporting member, and a screw head which is provided at an axial end portion of the screw shaft and arranged opposite to the contact portion.

25. The developing apparatus according to claim 21, further comprising a first sealing member, which is arranged astride the blade and the case at longitudinal end portions of the case and is frictioned with a surface of longitudinal end portions of the developer retainer.

26. The developing apparatus according to claim 25, wherein the first sealing member comprises: a base which is provided at an opposed position of longitudinal end portions of the developer retainer at the case and has elasticity; and a friction member which is provided respectively astride longitudinal end portions of the blade and the base and is fractioned with a surface of the developer retainer.

27. The developing apparatus according to claim 15, further comprising an attachment member, which is respectively provided at the blade longitudinally lateral to the first fastening member and the second fastening member, for attaching the blade to the case.

28. The developing apparatus according to claim 15, further comprising a presser, which extends in a longitudinal direction of the blade at said one side end portion of the blade and is pressed to a surface of the developer retainer, wherein the first fastening member and the second fastening member are provided medial to edges of the presser in a longitudinal direction of the blade.

29. A detachable process cartridge for an image forming apparatus, comprising a developing apparatus according to claim 15.

30. An image forming apparatus comprising a developing apparatus according to claim 15 or a process cartridge according to claim 29.

* * * * *